US007424933B2

(12) United States Patent
Weiss

(10) Patent No.: US 7,424,933 B2
(45) Date of Patent: Sep. 16, 2008

(54) LADDER ASSEMBLIES

(75) Inventor: Yoram Weiss, Pepper Pike, OH (US)

(73) Assignee: Norman Miller, Wooster, OH (US)

( * ) Notice: Subject to any disclaimer, the term of this patent is extended or adjusted under 35 U.S.C. 154(b) by 0 days.

(21) Appl. No.: 10/446,744

(22) Filed: May 28, 2003

(65) Prior Publication Data

US 2004/0129497 A1 Jul. 8, 2004

Related U.S. Application Data

(60) Provisional application No. 60/383,516, filed on May 28, 2002.

(51) Int. Cl.
*E06C 1/00* (2006.01)

(52) U.S. Cl. ..... 182/163; 16/328

(58) Field of Classification Search ..... 182/163; 403/49, 93, 98, 108, 104; 16/328, 329, 331
See application file for complete search history.

(56) References Cited

U.S. PATENT DOCUMENTS

| | | | | |
|---|---|---|---|---|
| 437,936 | A | 10/1890 | O'Brien | |
| 3,420,333 | A | 1/1969 | Atchison | |
| 3,692,143 | A | 9/1972 | Kummerlin et al. | |
| 3,729,063 | A | 4/1973 | Hein | |
| 3,811,151 | A * | 5/1974 | Kuemmerlin | 16/329 |
| 3,849,834 | A | 11/1974 | Mayer | |
| D248,777 | S | 8/1978 | Spencer et al. | |
| 4,152,810 | A | 5/1979 | Martinez | |
| 4,155,422 | A | 5/1979 | Larson et al. | |
| 4,182,431 | A | 1/1980 | Wing | |
| 4,202,428 | A | 5/1980 | Hickman | |
| 4,210,224 | A | 7/1980 | Kummerlin et al. | |
| 4,256,200 | A | 3/1981 | Loix | |
| 4,284,171 | A | 8/1981 | Owen | |
| 4,376,470 | A | 3/1983 | Ashton | |
| 4,469,193 | A | 9/1984 | Rumsey, Jr. | |
| 4,493,392 | A | 1/1985 | Alimbau Marques | |
| 4,502,566 | A | 3/1985 | Wing | |
| 4,519,478 | A | 5/1985 | Hulme et al. | |
| 4,540,306 | A | 9/1985 | Wang | |
| 4,566,150 | A | 1/1986 | Boothe | |
| 4,577,986 | A | 3/1986 | Wang | |
| 4,666,328 | A | 5/1987 | Ryu | |

(Continued)

*Primary Examiner*—Alvin C Chin-Shue
(74) *Attorney, Agent, or Firm*—Woodward, Emhardt, Moriarty, McNett & Henry LLP

(57) ABSTRACT

A folding ladder includes a hinge assembly having first and second ladder hinge plates each defining a plate opening and a plurality of locking slots. A housing is associated with the first ladder hinge plate and extends through the plate openings to provide a rotation axis for the plates, and the second plate is operable to rotate relative to the first plate about the rotation axis to selectively align slots of the first and second plates. A key outside the housing selectively engages aligned slots to selectively prevent rotation of the ladder hinge plates about the rotation axis and is operated by a manual rotation member. An extension ladder includes a pair of nested outer and inner ladder rails. Ladder rungs connected between and the inner rails define a plurality of supporting openings and the inner rails include outer bearing surfaces associated with the supporting openings. An extension latch mechanism having a pivoting dog is coupled to an outer rail and engages the supporting openings and outer bearing surfaces to support the ladder in an extended posision.

14 Claims, 35 Drawing Sheets

U.S. PATENT DOCUMENTS

| | | | | | |
|---|---|---|---|---|---|
| 4,697,305 | A | | 10/1987 | Boothe | |
| 4,770,559 | A | | 9/1988 | Yoo | |
| 4,773,503 | A | | 9/1988 | Purkapile | |
| 4,796,727 | A | | 1/1989 | Eaton | |
| 4,924,970 | A | | 5/1990 | Seals et al. | |
| 4,926,964 | A | | 5/1990 | Herrin | |
| 4,934,485 | A | | 6/1990 | Purkapile | |
| D309,502 | S | | 7/1990 | Wing et al. | |
| 4,974,701 | A | | 12/1990 | Parise | |
| 5,000,289 | A | | 3/1991 | Sanchez, III | |
| 5,062,179 | A | * | 11/1991 | Huang | 16/436 |
| 5,074,377 | A | | 12/1991 | Krause | |
| 5,123,768 | A | * | 6/1992 | Franklin | 403/96 |
| 5,163,532 | A | | 11/1992 | McCarty | |
| 5,228,535 | A | | 7/1993 | McCarty | |
| 5,279,387 | A | | 1/1994 | Swiderski et al. | |
| 5,350,038 | A | | 9/1994 | Lazarus | |
| 5,358,352 | A | * | 10/1994 | Klarhorst | 403/104 |
| 5,520,474 | A | * | 5/1996 | Liu | 403/97 |
| 5,620,272 | A | * | 4/1997 | Sheng | 403/96 |
| 5,743,355 | A | | 4/1998 | McDonnell et al. | |
| 5,775,460 | A | | 7/1998 | Stone | |
| 5,992,566 | A | | 11/1999 | Yeh | |
| 6,086,284 | A | * | 7/2000 | Callahan | 403/93 |
| 6,115,886 | A | * | 9/2000 | Fujita | 16/330 |
| 6,220,389 | B1 | | 4/2001 | Krause | |
| 6,237,718 | B1 | | 5/2001 | Schwarzel | |
| 6,330,733 | B1 | * | 12/2001 | Rauschenberger | 16/326 |
| 6,343,406 | B1 | * | 2/2002 | Yeh | 16/328 |

* cited by examiner

LADDER ASSEMBLIES

RELATED APPLICATION DATA

The present application claims the benefit of U.S. Provisional Application Ser. No. 60/383,516 filed on May 28, 2002, the disclosure of which is hereby incorporated by reference.

BACKGROUND

The present invention relates to the field of ladders. More particularly, but not exclusively, the present invention relates to step ladders, extension ladders, folding ladders, and combinations thereof.

SUMMARY

One embodiment of the present invention includes a unique locking hinge for folding ladders. Another embodiment of the present invention is a unique mechanism for locking extension ladders in extended and retracted position. Still other embodiments of the present invention are unique ladder assemblies. Still other embodiments include unique methods, systems, devices, and apparatus for constructing and using ladders.

Another embodiment of the present invention is a hinge assembly for a folding ladder comprising at least first and second ladder hinge plates each defining a plate opening and a plurality of locking slots; a housing associated with the first ladder hinge plate and extending through the plate openings to provide a rotation axis for the plates wherein the second plate is operable to rotate relative to the first plate about the rotation axis to selectively align slots of the first and second plates; a key outside the housing operable to selectively engage aligned slots to prevent relative rotation of the ladder hinge plates about the rotation axis when the key is engaged with the aligned slots; and a manual rotation member operably coupled to the key to selectively disengage the key from at least one of the aligned slots by rotation of the member a predetermined amount from a rotation member resting position.

Another embodiment of the present invention is a ladder hinge assembly comprising a housing providing a rotation axis for at least first and second ladder hinge plates wherein the plates can rotate about the rotation axis to selectively align locking slots in the first and second plates; a key outside the housing operable to selectively engage aligned slots to prevent relative rotation of the ladder hinge plates about the rotation axis when the key is engaged with the aligned slots; a manual rotation member; and means for converting manual rotation of the manual rotation member into translational movement of the key relative to aligned slots to selectively disengage the key from at least one of the aligned slots by rotation of the member a predetermined amount from a rotation member resting position. In certain refinements, the predetermined amount is less than about 180 degrees and/or the rotation member can be rotated in either a clockwise or counterclockwise direction to disengage the key from the locking slots.

Another embodiment of the invention is an extension ladder comprising a pair of outer ladder rails and a pair of inner ladder rails slidably received within the outer rails wherein the inner and outer rails each have a plurality of ladder rungs connected therebetween and the inner rails define a plurality of supporting openings and the inner rails include outer bearing surfaces associated with the supporting openings; and an extension latch mechanism coupled to an outer rail operable to prevent relative retraction of the inner and outer rails when the inner and outer rails are placed into a selected extended orientation, the latch mechanism including a dog pivotally coupled to the outer rail and having a first dog portion operable to engage in one of the supporting openings in the inner rails and a second dog portion rigidly coupled to the first dog portion and operable to contact the associated outer bearing surface when the first dog portion is engaged in the supporting opening to prevent relative retraction of the inner and outer rails from the selected extended orientation when the first dog portion is engaged in the supporting opening.

One object of the invention is to provide a locking hinge for folding ladders such as step ladders and articulating ladders.

Another object of the invention is to provide a mechanism for locking extension ladders in extended and retracted positions.

Another object of the invention is to provide a novel technique for assembling ladders with outrigger leg supports.

Another object of the invention is to provide a novel technique for assembling rungs to ladders having nested inner and outer rails.

Further embodiments, forms, features, aspects, benefits, objects, and advantages shall become apparent from the detailed description and figures provided herewith.

DESCRIPTION OF ILLUSTRATED EMBODIMENTS

Figure 1:
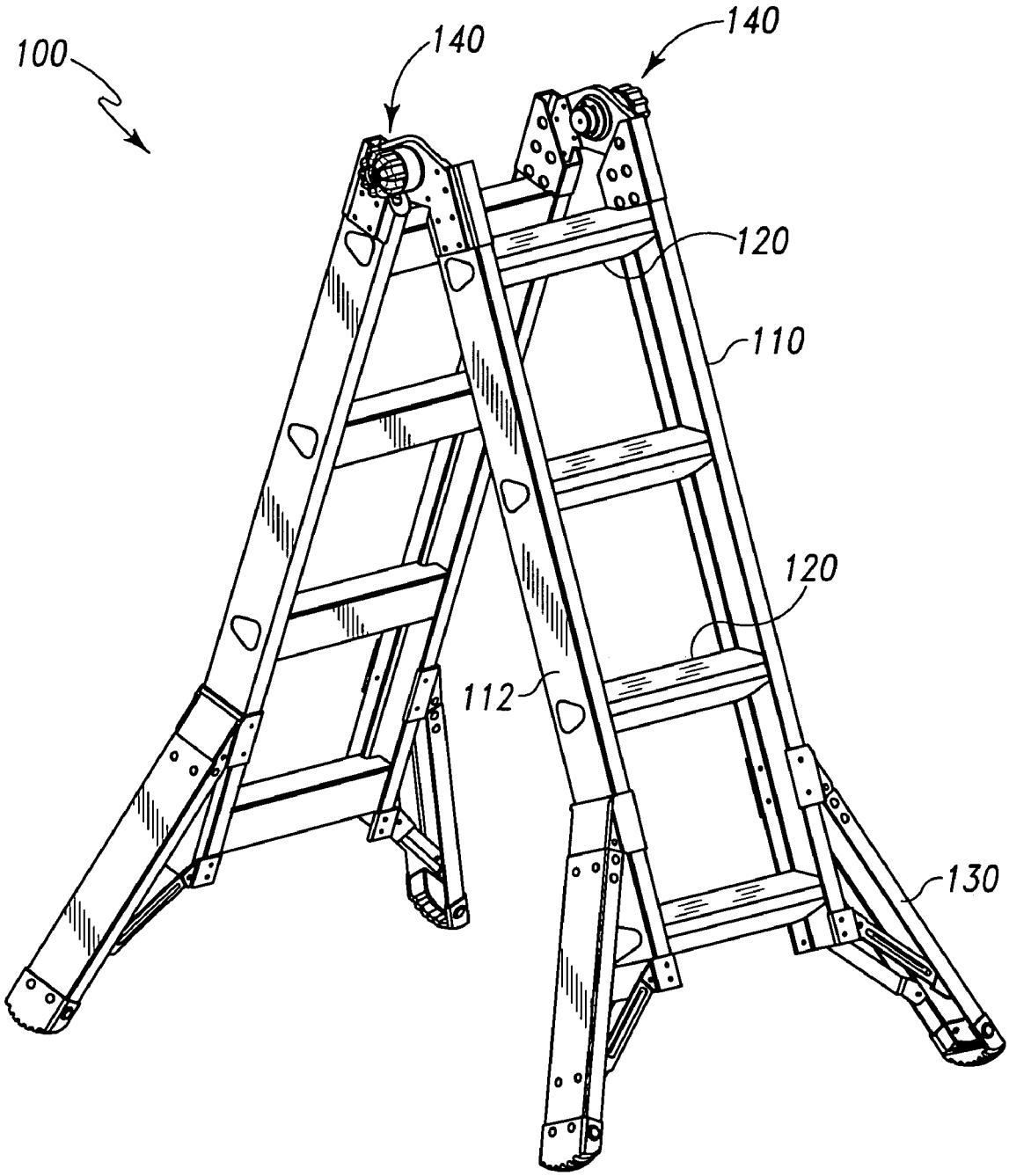
FIG. 1 is a two-section stepladder according to one embodiment of the present invention, shown in an open position.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Turning now to FIG. 1, ladder 100 according to one embodiment of the present invention includes a pair of ladder sections pivotally joined together by a pair of hinge assemblies 140. Each ladder section includes a pair of side rails 110, 112 with a plurality of spaced rungs 120 extending between the side rails. Hinge assemblies 140 join the side rails of the ladder sections and permit the ladder sections to be articulated and locked into multiple positions. Ladder 100 can be locked in an open step ladder configuration with the ladder sections at an acute angle (as illustrated) or a closed or folded configuration with the ladder sections parallel (for storage or transport).

Figure 2A:
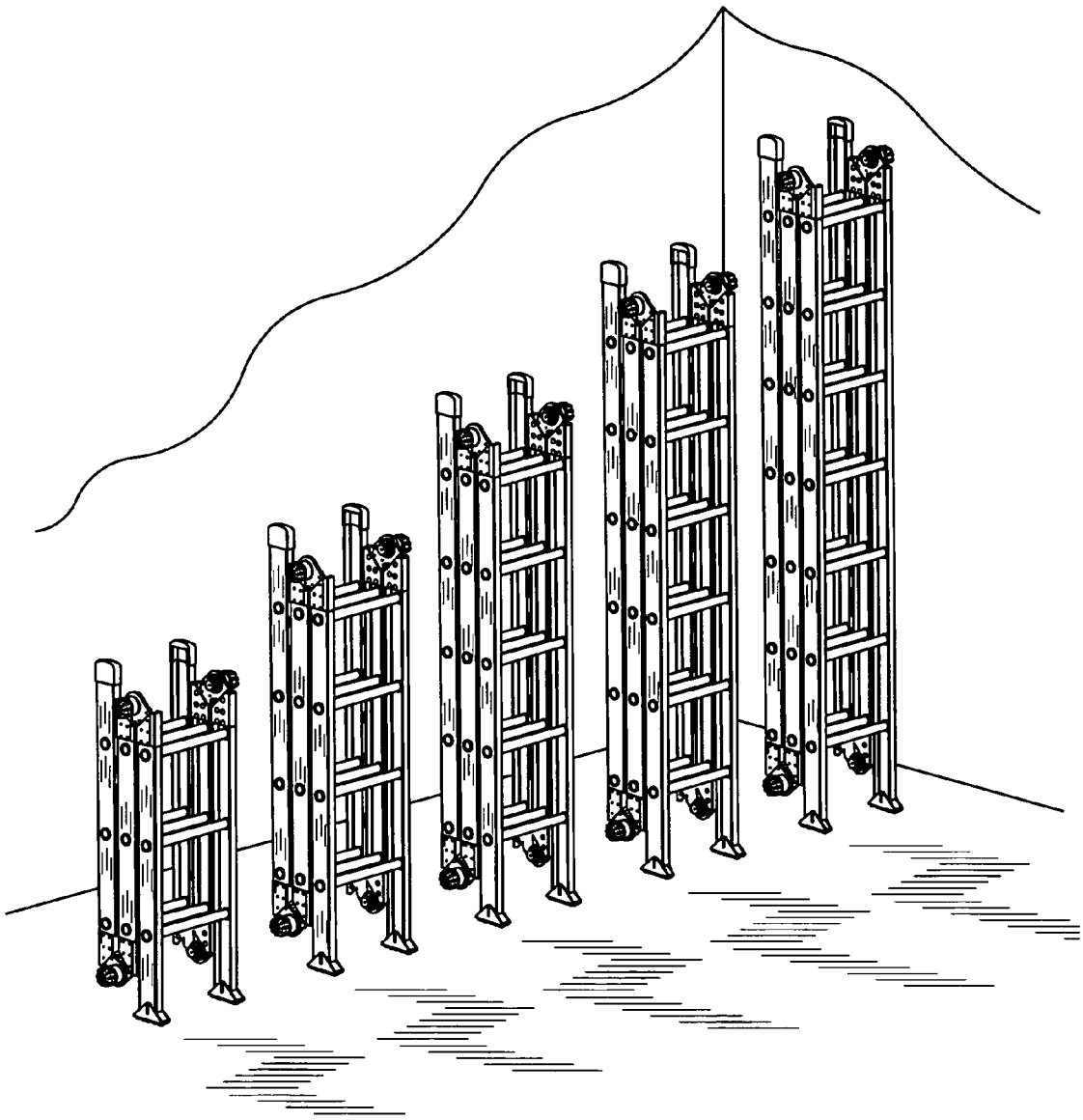
FIGS. 2A and 2B are three-section folding ladders according to other embodiments of the present invention, shown in folded (FIG. 2A) and extended (FIG. 2B) positions.
Figure 2B:
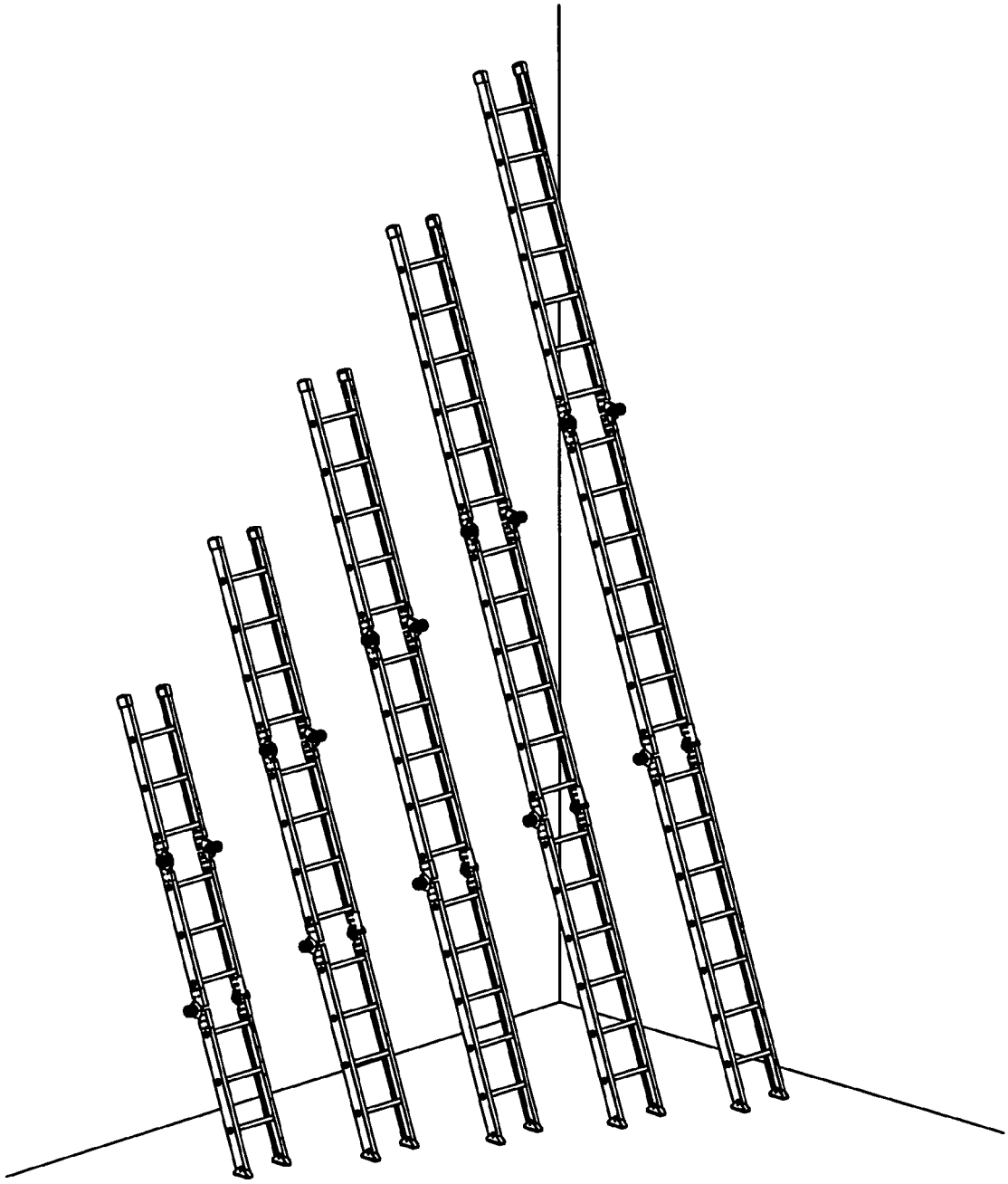
Figure 3A:
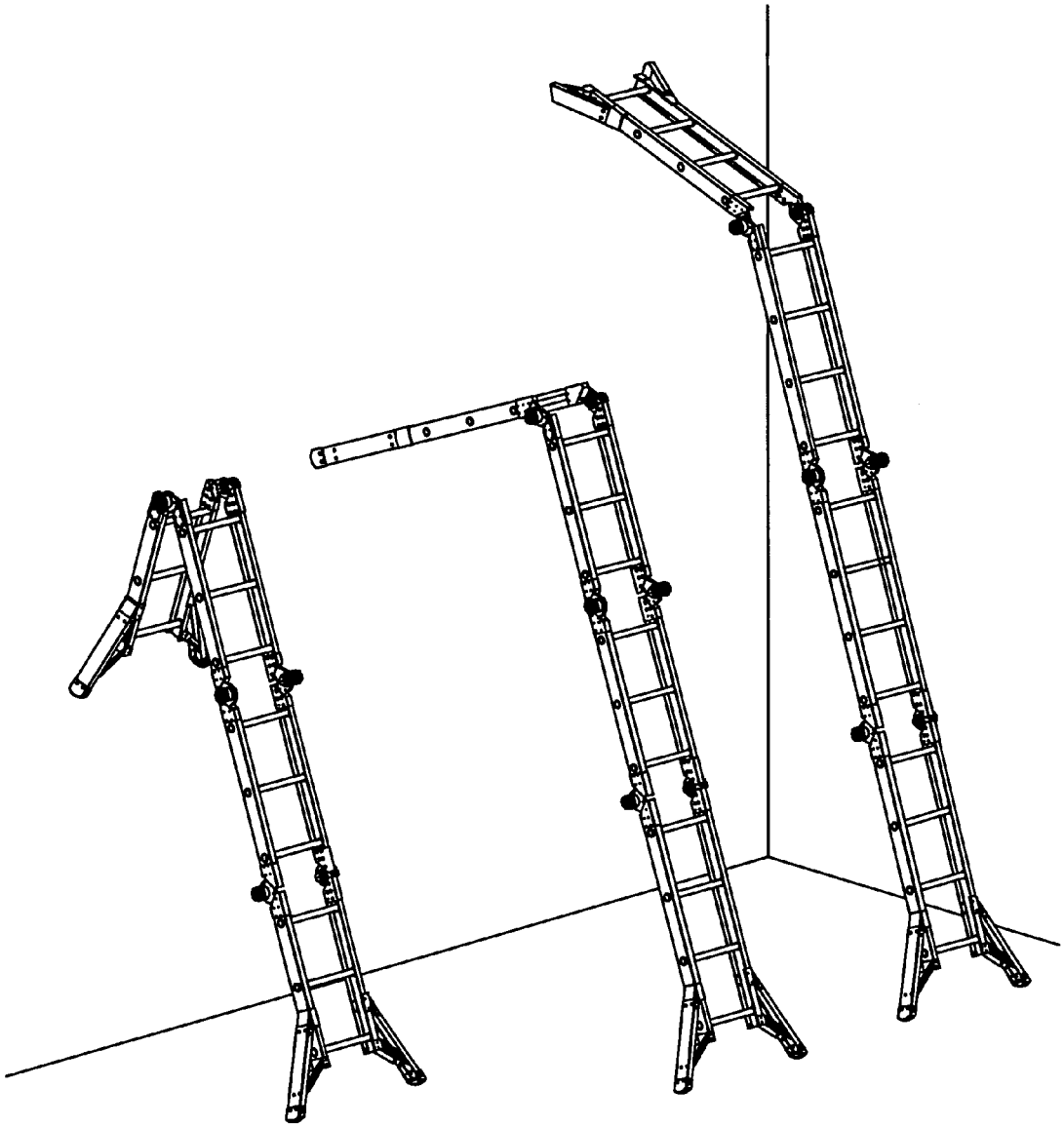
FIGS. 3A and 3B are four-section folding ladders according to still other embodiments of the present invention.
Figure 3B:
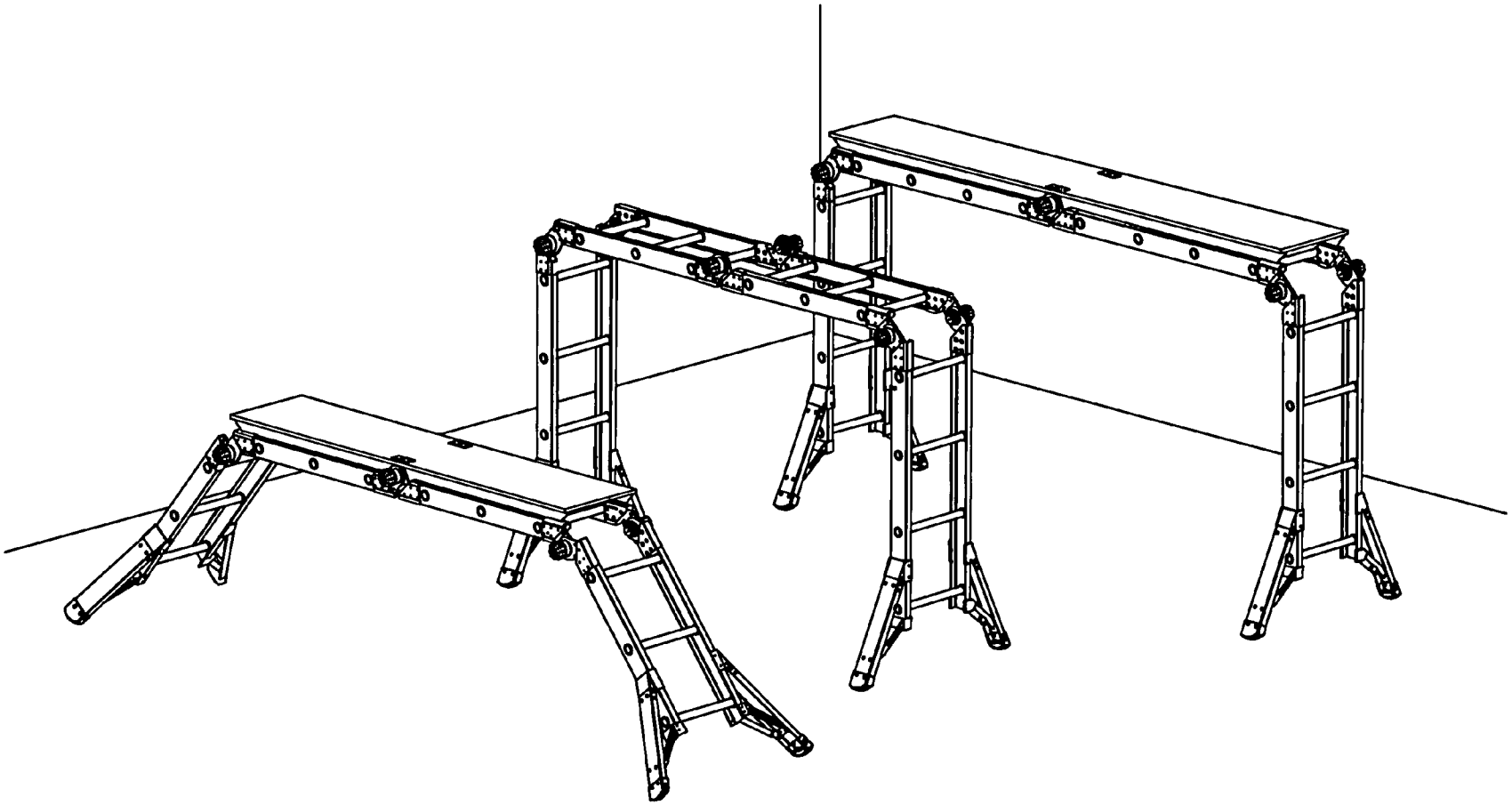
Figure 4:
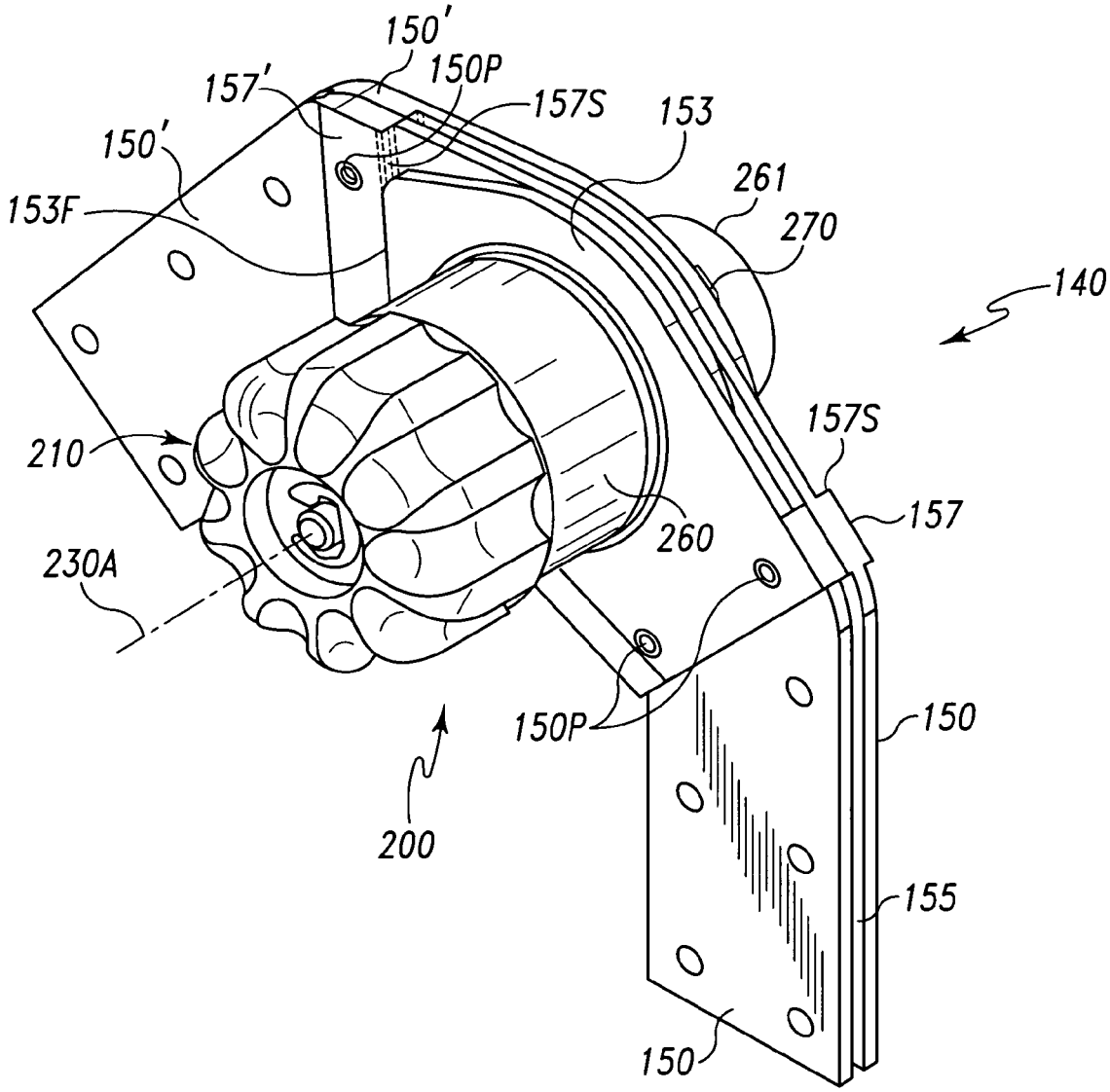
FIG. 4 is a perspective view of a ladder hinge assembly for the FIG. 1 stepladder, shown in the locked position.

Other multi-section folding ladders according to the present invention are depicted in FIGS. 2-3. FIGS. 2A and 2B depict three section ladders in folded (FIG. 2A) and straight (FIG. 2B) configurations, and FIGS. 3A and 3B depict four section ladders in other useful locked configurations.

Turning now to FIGS. 4-8 hinge assembly 140 for ladder 100 is depicted. Assembly 140 includes a pair of right and left side ladder hinge plates 150, 150' respectively, each defining a central opening 152 and a plurality of locking slots 154 and 156 spaced about the periphery of and in communication with the central opening 150. In the illustrated embodiment, plates 150 and 150' are identical in construction and include a hinge portion 153 and a rail portion 151 with an intermediate shoulder portion 157 having a stop abutment surface 157S. The plates 150, 150' are alternately stacked with corresponding surfaces facing and openings 152 aligned (see FIGS. 4 and 5) to form a plate stack. A pair of split spring pins 150P connect together the plates of each pair such as plates 150 for that pair, and plates 150' for that pair. The connections are at the shoulder portion 157, 157' which is the widest (thickest) portion of the hinge plates. The hinge portions 153 are offset from the shoulder portion 157, and the rail portions 151 are thinner than the shoulder portions 157 such the plate stack defines a pair of coplanar slots 155. The slots 155 receive ladder rails (not shown) for connection of the hinge plates 150, 150' to adjacent ladder sections, for example after formation of the hinge assembly 140.

Figure 5:
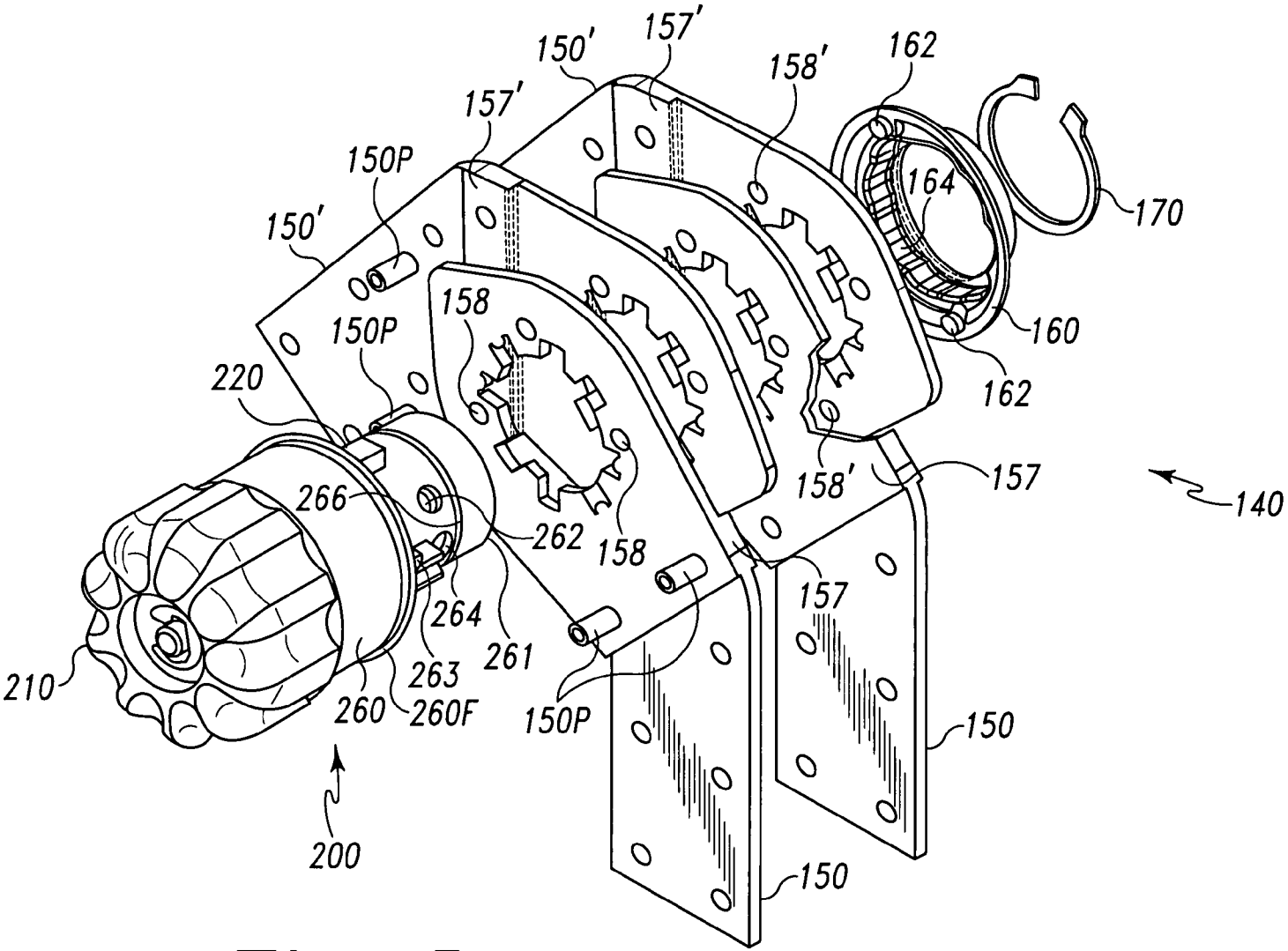
FIG. 5 is a perspective exploded view of the hinge assembly of FIG. 4.

Key assembly 200 provides a hinge axis for the plates 150, 150' and provides locking members for selectively locking the hinge plates in selected orientations. Key assembly 200 includes housing 260, knob 210, key 220, and piston 230 (see FIG. 7). Housing 260 includes a lower cylindrical portion 261 that extends through the openings 152 of the plate stack to provide the rotation or hinge axis 230A for the hinge plates 150, 150'. The upper portion of housing 260 includes a flange portion 260F that is wider than the lower cylindrical portion 261 and includes a pair of posts 263 (FIG. 8) that engage in holes 158 in the first plate 150 (FIG. 5). Posts 263 serve to mate housing 260 to the adjacent right side plate 150 to prevent relative rotation of housing 260 and the right side plates 150. The end of the lower portion 261 of housing 260 extends out the far side of the plate stack and receives a cam ring 160. Cam ring 160 (FIG. 5) includes index posts 162 for mating with holes 158' in the hinge portion of the far left side plate 150'. A retaining ring 170 fits in perimetrical snap ring groove 266 in housing portion 261 to hold the housing 260 and cam ring 160 in position relative to the plate stack.

It is to be understood that, as the plates 150' rotate about the housing 260 and relative to plates 150, sets of slots 154 in the plate stack become aligned. Key 220 includes rigid key members 222, 224 configured to selectively engage in the aligned slots 154, 156. When engaged in aligned slots, the key 220 prevents further relative rotational movement of the hinge plates 150, 150', thereby locking the ladder rails into a particular angular relationship. As described more fully below, knob 210 is operable to remove members 222, 224 from engagement with the aligned slots, thereby rendering plates 150 free to rotate relative to plates 150' to another angular relationship.

Figure 7:
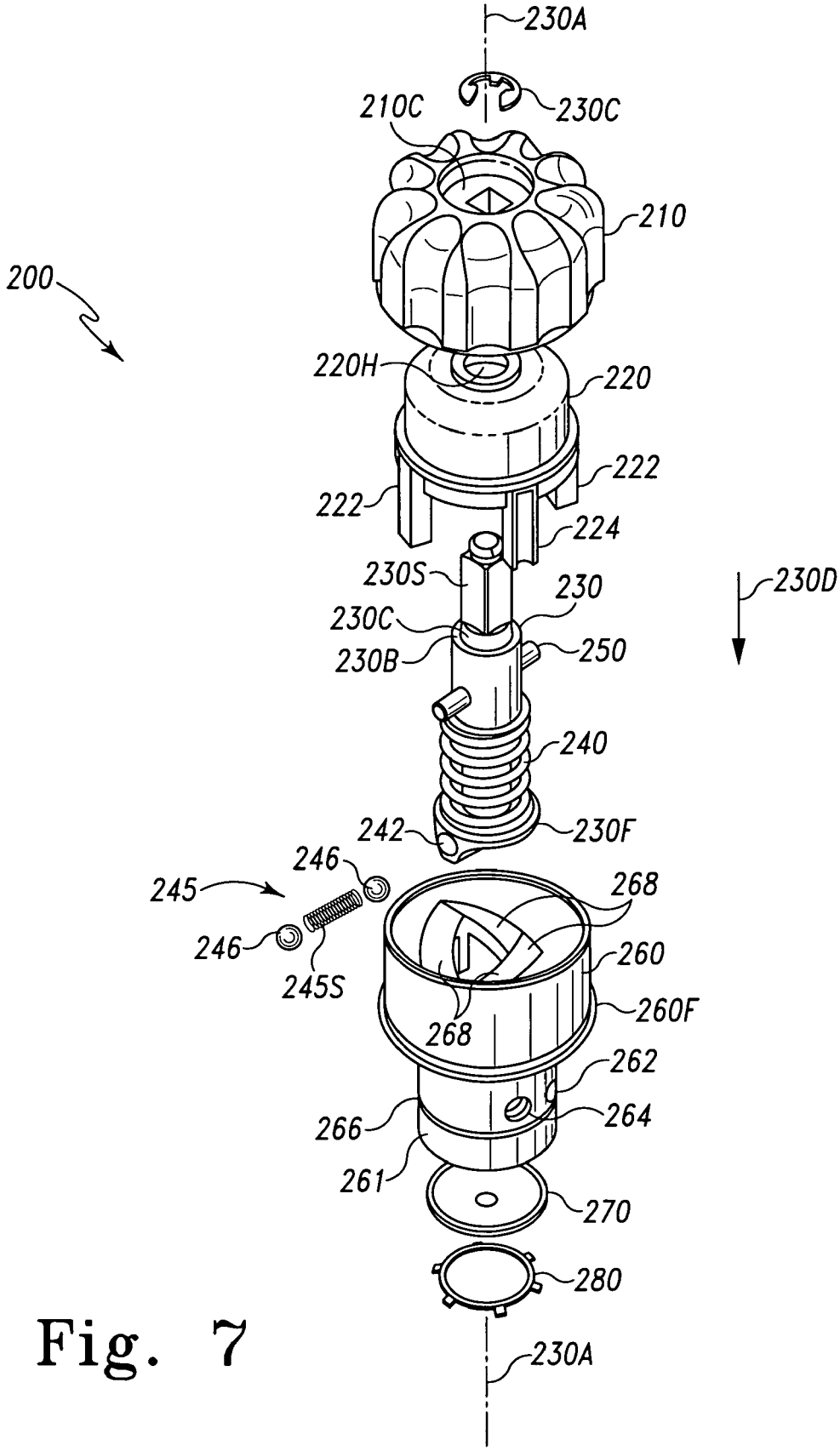
FIG. 7 is a perspective exploded view of the key assembly for the FIG. 4 hinge assembly.
Figure 8:
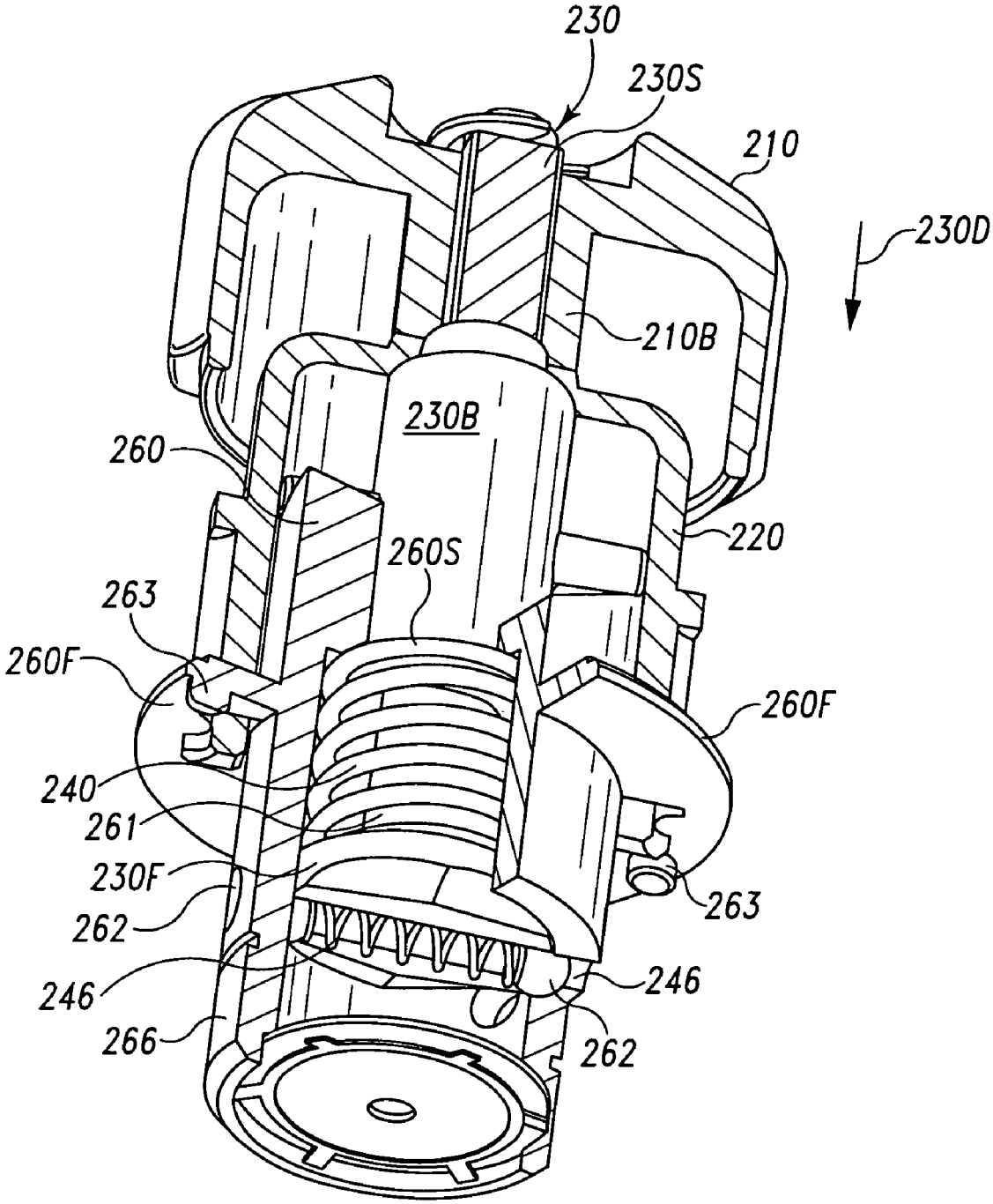
FIG. 8 is a perspective cutaway view of the FIG. 7 key assembly.
Figure 9:
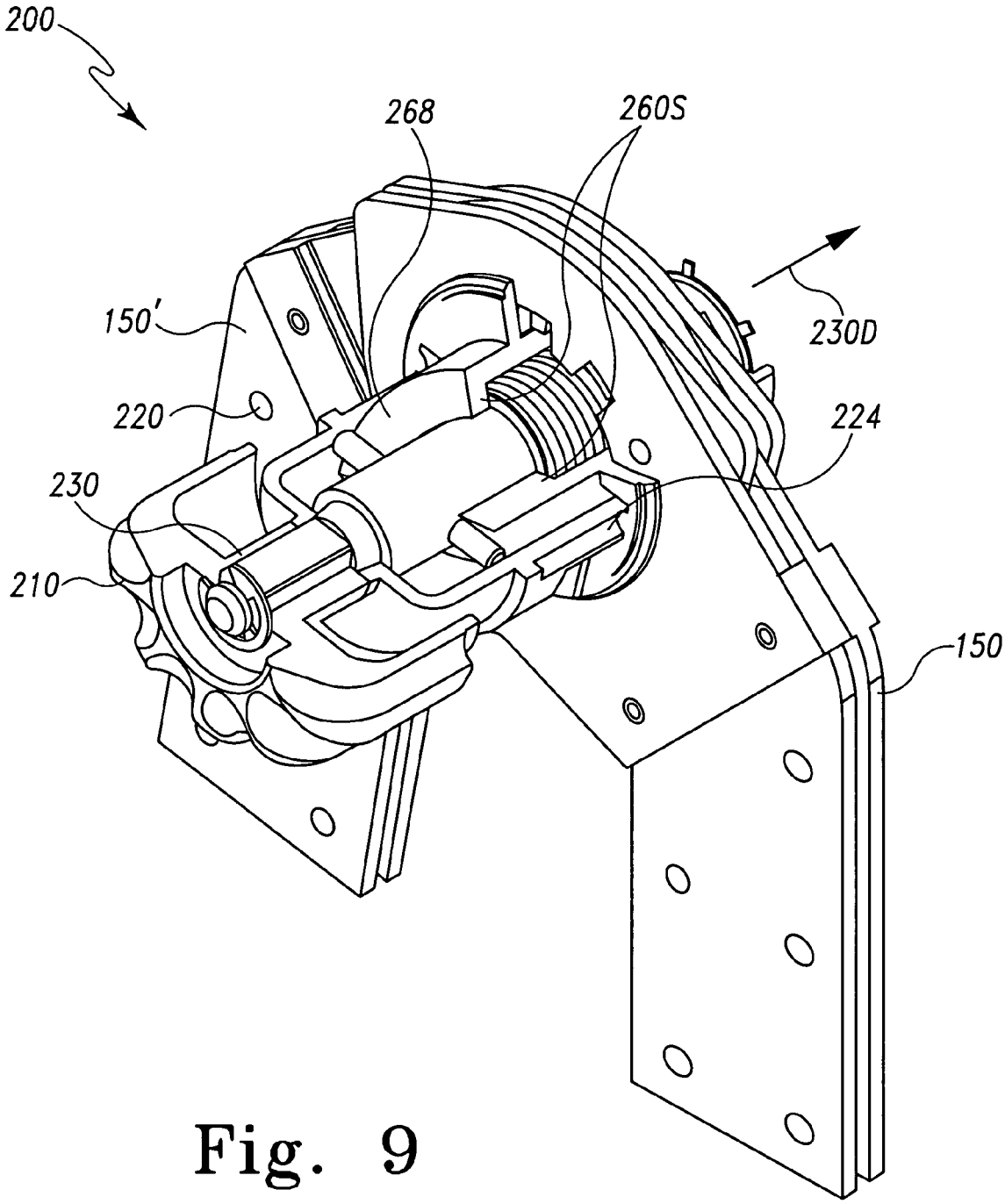
FIG. 9 is a perspective cutaway view of the FIG. 4 hinge assembly, shown in the unlocked position.

Turning now to FIGS. 7-9, further details of key assembly 200 are depicted. In FIGS. 8-9, a portion of knob 210, key 220, and the housing 260 have been cut away to show internal features. Piston 230 is mounted in housing 260 for limited rotational and longitudinal movement therein. Extension members or posts 250 are fixed to and extend out opposite sides of piston 230. Compression spring 240 is mounted around the lower portion of piston 230 inside portion 261 of housing and is compressed between a lower flange 230F of piston 230 and an opposed interior surface 260S (FIGS. 8-9) of housing 260. Thus, compression spring 240 biases piston 230 in a longitudinal direction of arrow 230D (FIGS. 7, 8, 9) to have extension posts 250 in contact with one or the other pair of two pairs of ramped surfaces 268 of housing 260. It is to be understood that, as depicted in FIG. 7, the rotation axis 230A of piston 230 is vertical, passing through the axial center of spring 240. Posts 250 can be formed by fixing a single rigid dowel through a hole in piston 230, perpendicular to the rotation axis 230A of piston 230.

The upper portion of piston 230 receives key 220 and knob 210. Knob 210 includes a rectangular central opening 210C that is mounted to a rectangular mount stem 230S of piston 230 such that rotation of knob 210 serves to rotate piston 230. A clip 230C attaches to the end of the piston 230 to hold knob 210 on piston 230. Key 220 is rotatably mounted to piston 230 and includes a round opening 220H that is mounted around a correspondingly rounded collar portion 230C of piston 230. Key 220 is operably coupled for longitudinal movement with piston 230, being captured between the boss 210B (FIG. 8) of knob 210 and a corresponding bearing surface shoulder 230B (FIGS. 7 and 8) of piston 230.

Assembly 200 is mounted on the plate stack with assembly 200 in the locked position, having key members 222 and 224 extending from the underside of housing 260 and into engagement with aligned slots 154 and 156, respectively. Knob 210, which includes a textured or ergonomic surface to facilitate manual operation and twisting, is manually turned to cause piston 230 to rotate relative to housing 260. As piston 230 rotates, posts 250 ride up one pair of ramped surfaces 268 thereby causing piston to also longitudinally translate relative to housing 260 in a direction opposite arrow 230D so away from the hinge plates. The longitudinal translation of piston 230 causes key members 222 and 224 to withdraw from the engaged slots 154, 156. It is to be understood that because key members 222 and 224 pass through openings in the underside of housing 260 and are engaged with slots 154 and 156 in the plate stack, and because housing 260 is non-rotatably connected with the first plate 150 (nearest the knob 210) via posts 263 and holes 158, key 220 does not rotate with respect to housing 260. Rather, key 220 floats about the collar of piston 230, moving longitudinally with the piston 230 but not rotating with piston 230.

When assembly 200 is in the locked position (having members 222 and 224 of key 220 engaged in aligned slots 154 and 156, respectively, and locking the plates together) posts 250 are near the bottom of ramped surfaces 268. Surfaces 268 are ramped up in both directions from the ramp bottom resting position of posts 250 such that each of posts 250 is generally at the valley between two ramped surfaces 268. Therefore knob 210 can be turned in either a clockwise or counterclockwise direction from rest position to move the key 220 upward with piston 230 to the unlocked (plate unlocking) position. Surfaces 268 are ramped a sufficient amount such that less than a quarter turn (90 degrees about knob axis 230A) of knob 210 from the locked resting position is sufficient to move the key to the unlocked position, where key members 222, 224 remain engaged with the slots 154 and 156 of the first plate 150 but are otherwise out of engagement with aligned slots of the other plates in the stack. While other configurations are contemplated where more or less rotation of knob 210 is required to move the key 220 from a locked to an unlocked position, a rotation clockwise or counterclockwise in an amount considerably less than 90 degrees is preferred to facilitate ease of manual operation. It is to be understood that the amount of translational movement of key 220, and consequently the angle of the ramped surface sufficient to achieve the desired translational movement of key 220, will depend, at least to some extent, on the thickness of the plates 150, 150'. However, it is contemplated that in preferred embodiments the ramp angle, defined relative to the plane of the plate stack, will be greater than about 15 degrees and more preferably greater than about 25 degrees, for example between about 30 and 45 degrees.

Figure 13:
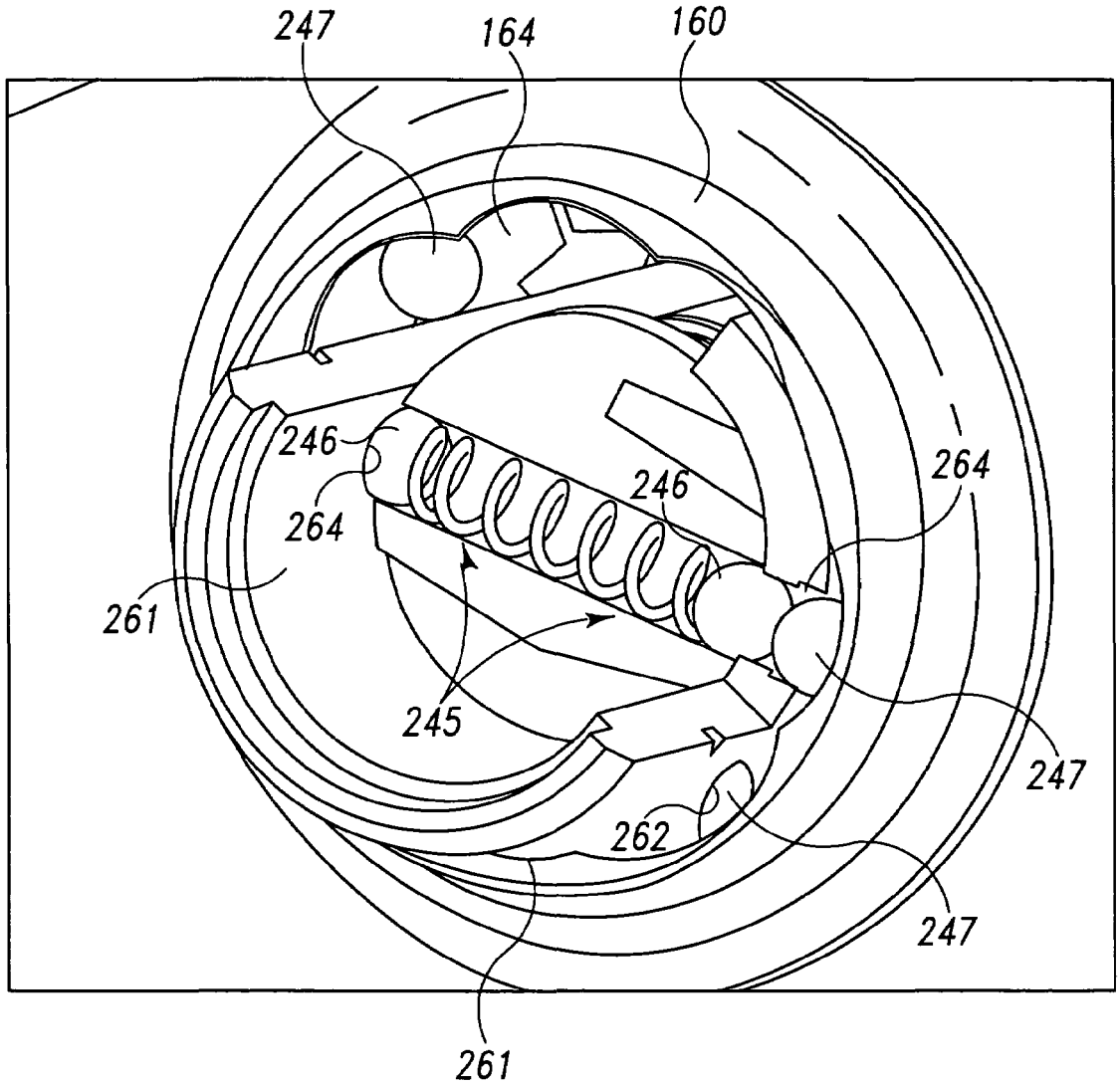
FIG. 13 is an enlarged rear perspective cutaway view of the FIG. 4 hinge assembly.
Figure 14:
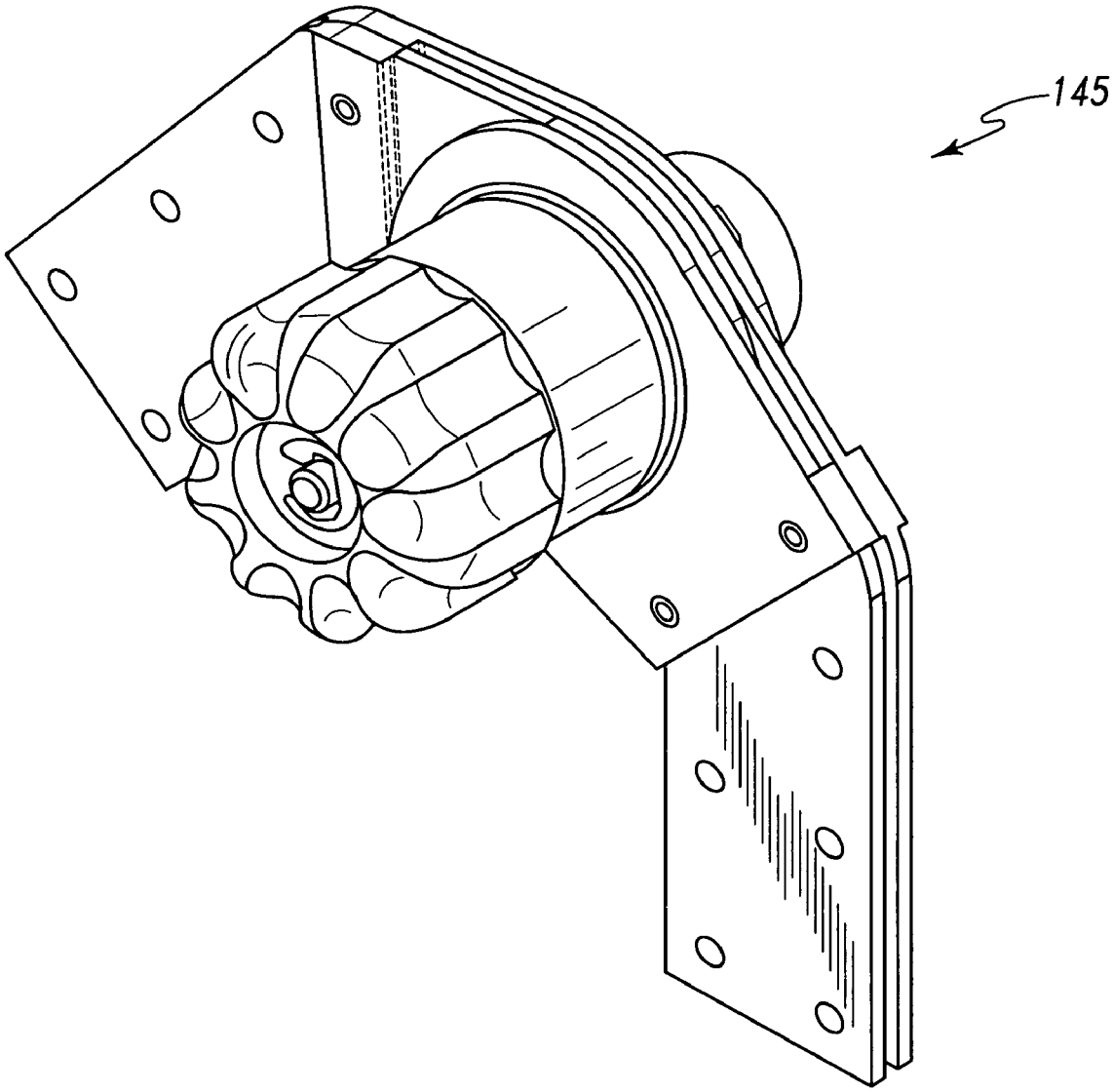
FIG. 14 is a perspective view of a hinge assembly according to another embodiment of the invention.

Detent assembly 245 (FIGS. 7, 8 and 13) is included in the lower portion of piston 230 to cooperate with openings 264, 262 in housing portion 261 to hold piston 230 in the unlocked position against the biasing force of spring 240. Detent assembly 245 includes a compression spring 245S between a pair of inside plungers in the form of detent balls 246 (FIGS. 7, 8, 13). Holes 264 are in diametrically opposite locations in housing portion 261. Holes 262 are in diametrically opposite locations in housing portion 261. The pair of holes 262 is on a diametrical line which may be about 20 degrees away from a diametrical line through the pair of holes 264. As piston 230 is rotated inside housing 260 in one direction from rest position by turning knob 210, the piston translates in direction opposite arrow 230D until balls 246 align with and are biased into engagement in openings 264. If knob 210 is rotated in the opposite direction, the balls will enter openings 262. In either case, i.e. when the pair of balls 246 enter openings 262 or 264, they will retain the piston in the retracted, key unlocked condition. The circular spacing between proximate holes 262 and 264, assures entry of detent balls into one pair of openings or the other pair, depending on direction of turning the knob, before posts 250 reach the crests (tops) of the ramps, thus assuring reliable retention of the piston and, thereby the key, in the plate unlocking position.

Outer plungers in the form of balls 247 (FIGS. 5 and 13) are also provided in the openings 262 and 264 to provide a release mechanism for the detent assembly 245. The inside and outside plunger balls are of identical size. The openings 262 and 264 are stepped circular holes with the inner portion of the holes being of lesser diameter than the outer portion as shown in FIG. 13. The inner portion diameter is less than the diameter of the balls such that, while the balls are in operative contact and can move partially into the openings, neither the inside nor the outside balls can pass all the way through an opening. The outer portion of each hole is large enough for the outer ball to enter the hole far enough to dislodge the inside balls from the openings in response to cam action during intentional opening or closing of the ladder, as will be described now.

Cam ring 160 surrounds housing portion 261 between retainer ring 170 and plate 150' to which the cam ring is mounted. The cam ring provides an interior surface 164 that retains the outer plungers 247 in openings 262 and 264. The interior surface 164 facing the outer cylindrical surface of surrounded housing portion 261 is in a wavelike undulating configuration, thus defining a series of cam peaks and troughs of unequal distance from the outer surface of housing portion 261. The ring index posts 162 index the cams relative to slots 154 and 156 of plate 150'. When the hinge assembly is in an unlocked position, the outer plungers 247 are in a peak portion (as depicted in FIG. 13). Because cam ring 160 and housing 260 are each associated with different hinge plates, when the hinge plates are articulated, for example going from a closed to an open step ladder configuration, cam 160 moves relative to housing 260 causing diametrically opposed trough portions of cam ring 160 to pass over outer plungers 247. The trough portions of cam surface 164 press inward on outer plungers 247 which in turn press on inner plungers 246 to thereby dislodge inner plungers 246 from openings 264. With plungers 246 no longer holding the piston, compression spring 240 drives piston 230 in the direction of arrow 230D to cause key 220 to engage with a new set of slots 154 and 156 once they become aligned by virtue of further articulation of the plate stack. A bottom piece 270 closes housing portion 261, and ring 280 retains it in place. Piece 270 is provided with a hole 271 to facilitate airflow during piston movement in the housing portion.

In other embodiments, leaves 150' can be used in place of cam 160 to dislodge inner plungers 256 during movement of the plate stack. In this embodiment housing 260 would be modified to locate openings 262, 264 in communication with leaves 150'.

Figure 6:
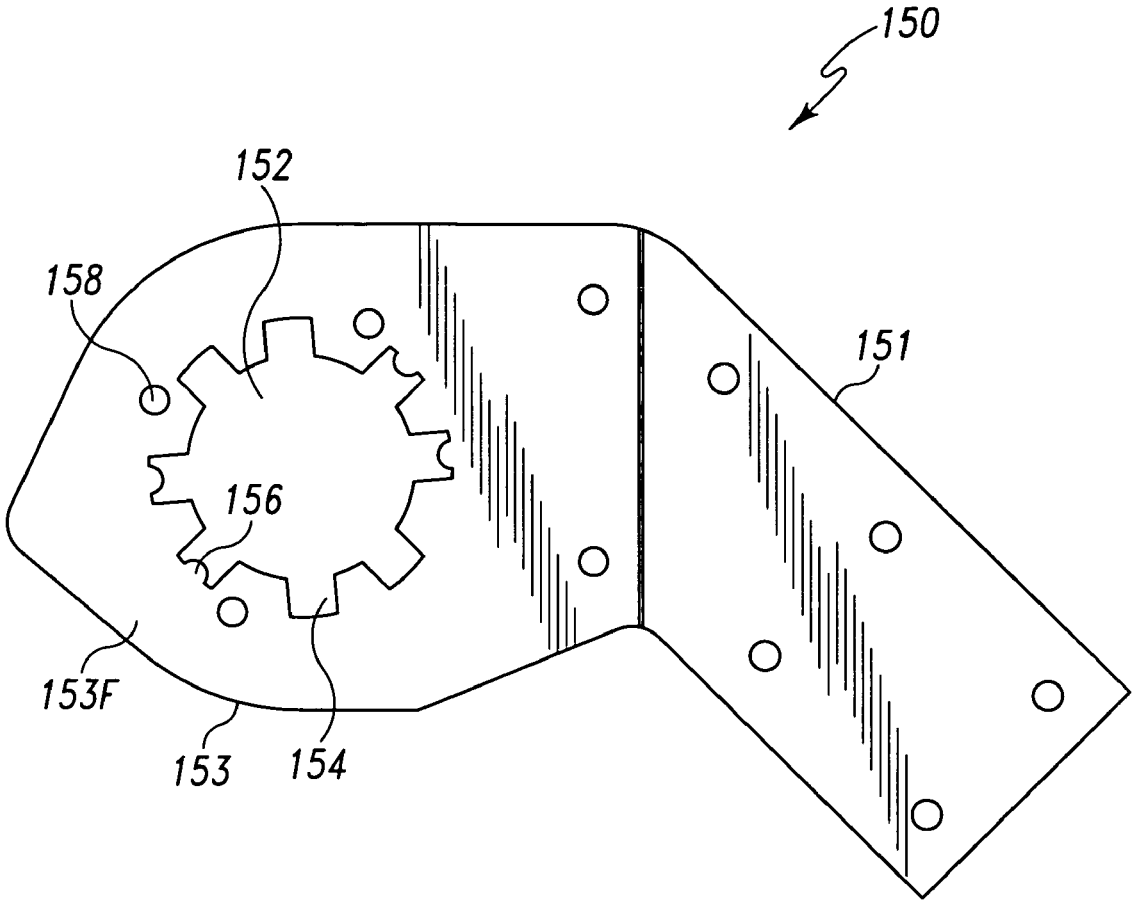
FIG. 6 is a side view of a ladder hinge plate of the FIG. 4 hinge assembly.
Figure 10:
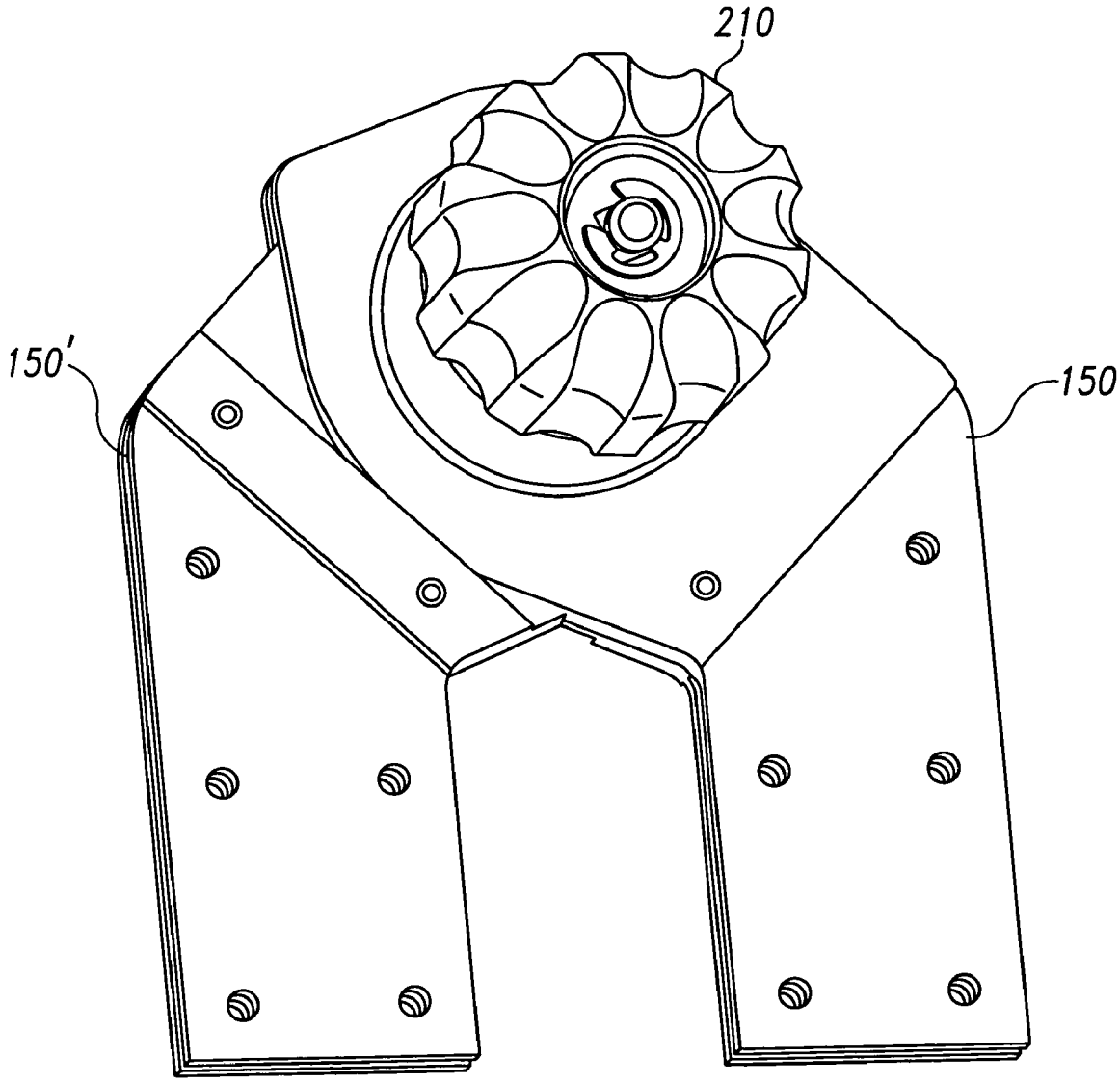
FIGS. 10 and 11 are front perspective views of the FIG. 4 hinge assembly in locked positions.
Figure 11:
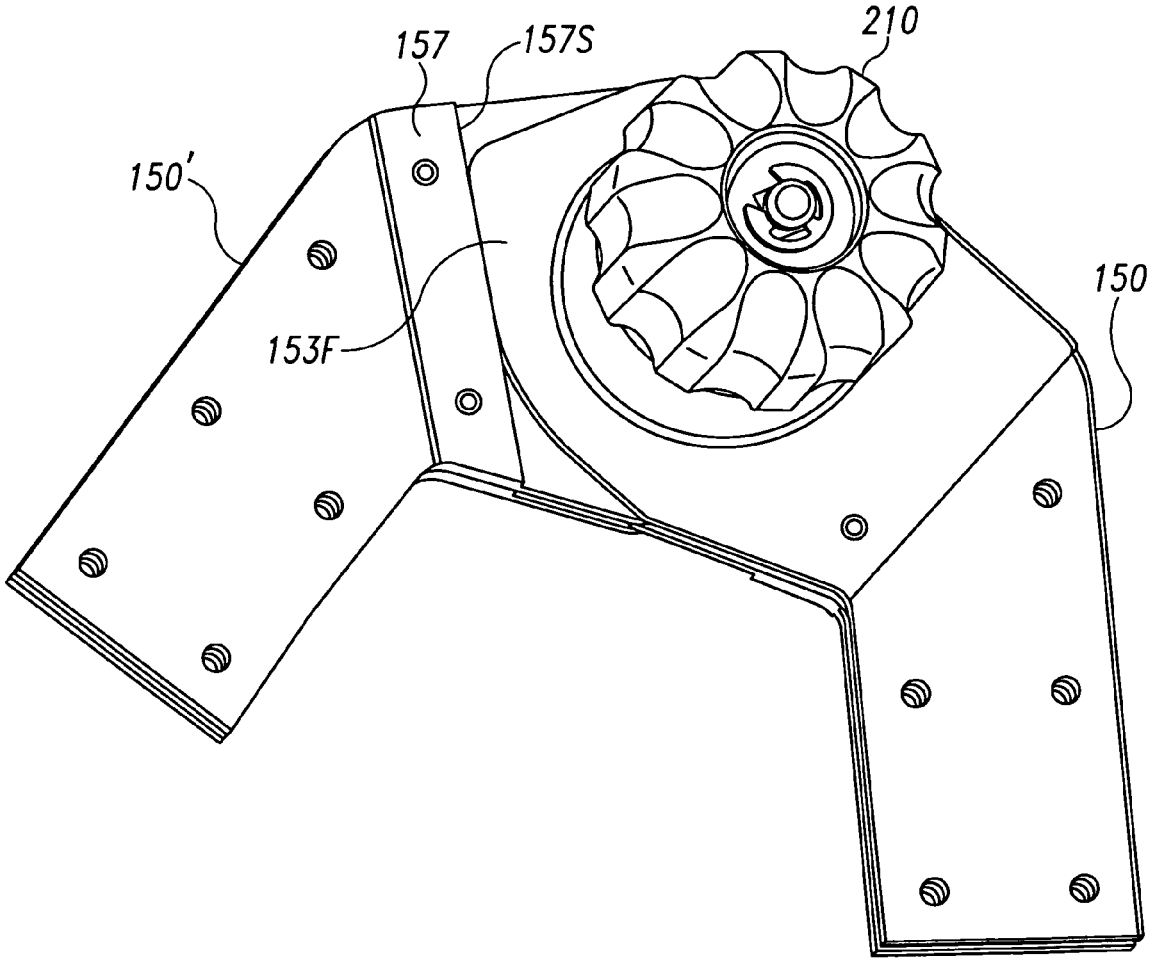
Figure 12:
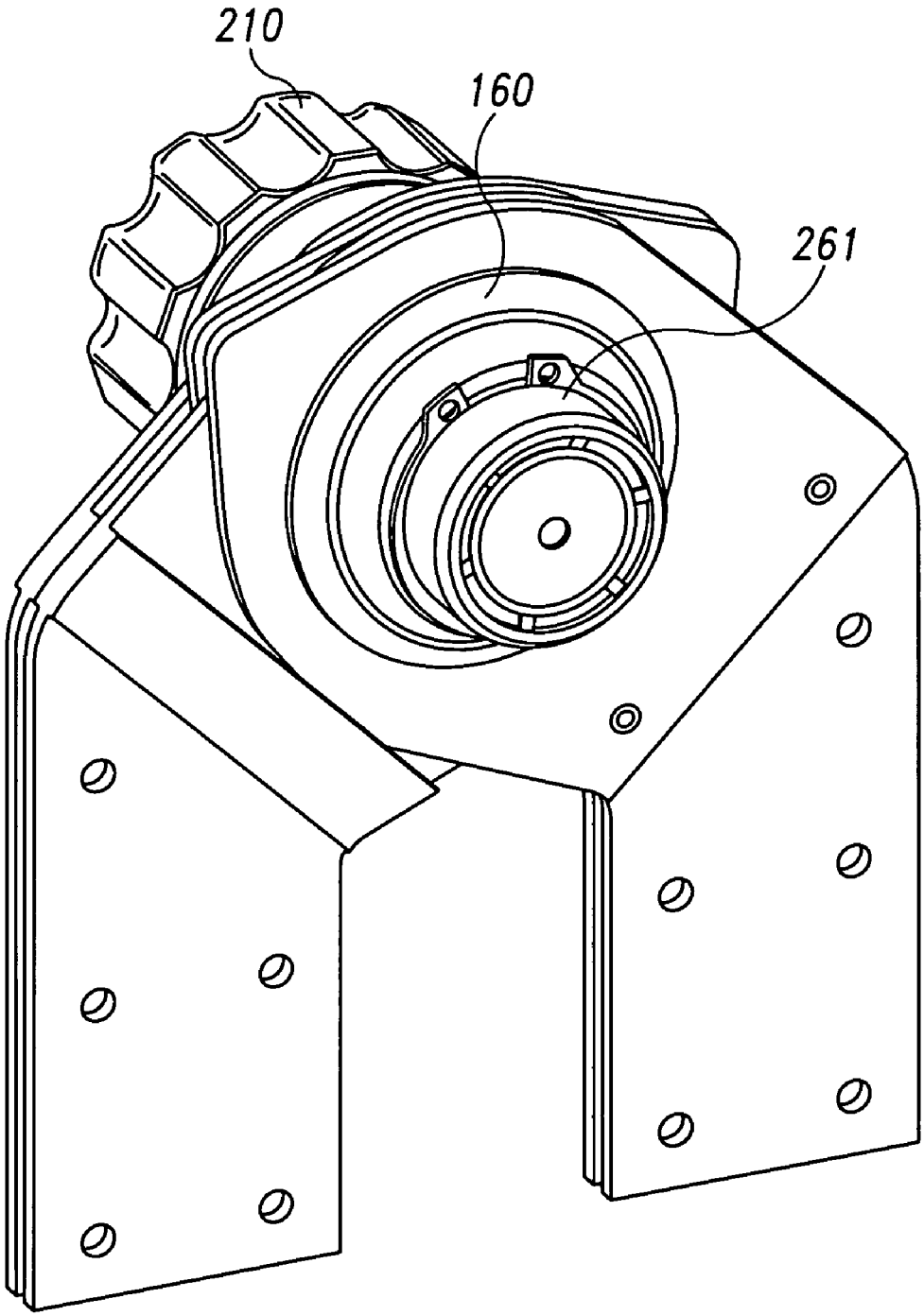
FIG. 12 is a rear perspective view of the FIG. 4 hinge assembly.

It is to be understood that in the illustrated embodiment, slots 154 and key members 222, 224 are of corresponding shape for relative engagement, and the location and relative configuration of the slots 154 determine the particular angular orientations in which the hinge plates 150, 150', and consequently the ladder rails, can be locked. As illustrated in FIG. 5, assembly 140 is configured to lock in two positions, an open (FIG. 11) and a closed (FIG. 10) step ladder configuration. As shown in FIG. 6, plate 150 includes eight slots 154 spaced about the periphery of opening 150 to receive the four key members 222, 224, which are equally spaced about the periphery of housing 260, in each of the locked configurations. All of the slots 154 are generally equal in width and depth to generally correspond to the outer dimensions of the key members 222, 224. Four of the slots 154 (two opposed pairs) are configured to receive members 222 in each of the locked positions. The remaining four slots 154 receive members 224 and include a projection 156 that alters the otherwise generally rectangular shape of the outer perimeter of the slots 154. Members 224 have a corresponding recess to cooperate with projections 156. It is to be understood that, by limiting certain of the slots 154 to engagement with members 224 and not members 222, the projections 156 limit the permissible angular orientations in which the stack of hinge plates can be locked. Projections 156 can be omitted where no such limitation of locked positions is desired. Limitations in locked positions could also be achieved by having the outer profile of members 222, 224 be different, such as rectangular and triangular, with corresponding changes in the slots 154.

Figure 15:
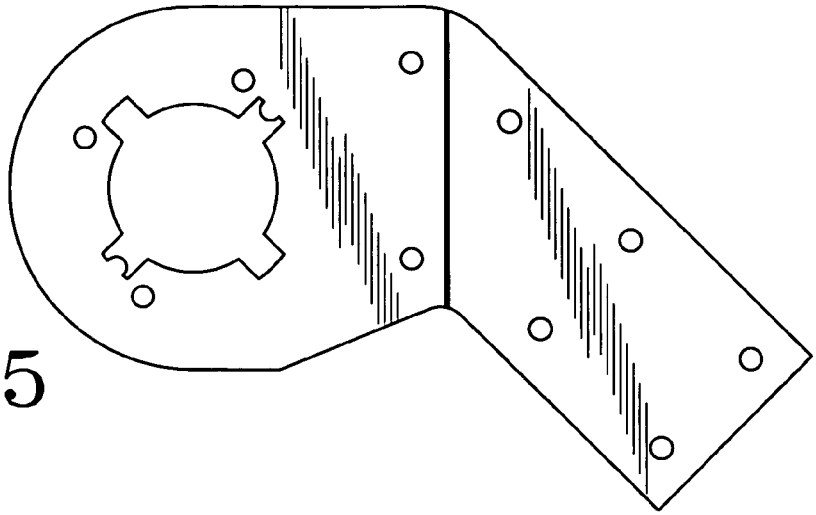
FIGS. 15-17 are side views of hinge plates for the FIG. 14 hinge assembly.
Figure 16:
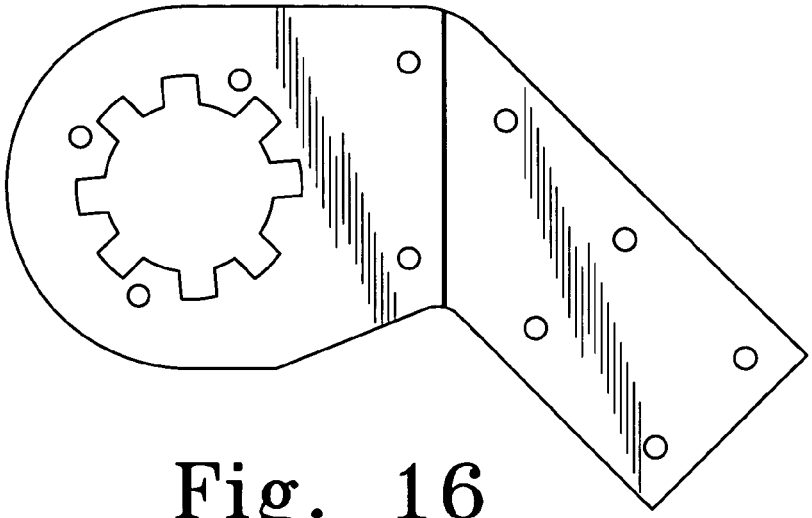
Figure 17:
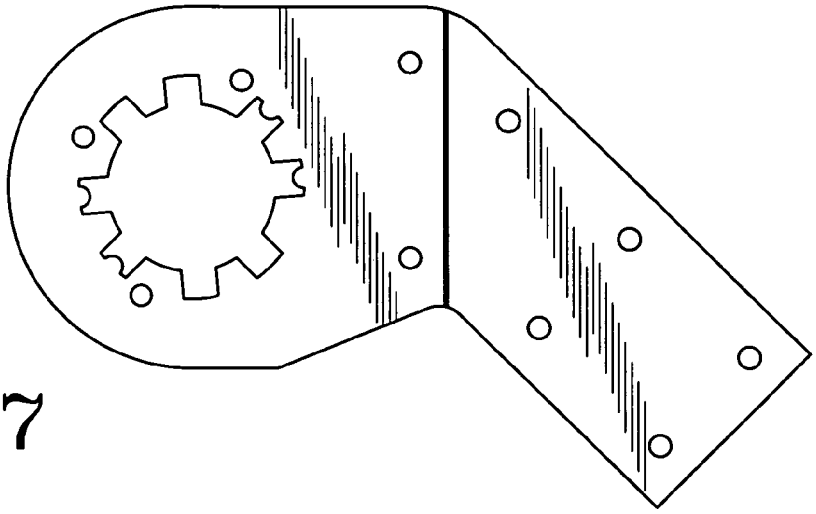

It is also to be understood that, in the open position (FIGS. 4 and 11), the outer end 153F of each of the hinge portion 153 of the plates 150, 150' rests against a corresponding flat surface of a shoulder portion 157 to provide additional strength and support for the hinge joint in the open position. This surface engagement also prohibits further opening of the joint beyond the open step ladder position of FIGS. 4 and 11. In embodiments where no such additional strengthening of the joint is required and/or additional movement of the joint is desired, the plates 150 can be configured to avoid such limiting surface contact, for example as depicted in the hinge assembly 145 and associated hinge plates of FIGS. 14-17. It is to be understood that hinge assembly 145 is otherwise identical to assembly 140 save that the outer surface of the plate portions is rounded to avoid limiting surface contact with the shoulder portions of the hinge plates, thereby permitting hinge assembly 145 to assume, among other positions, a 180 degree straight ladder configuration. As described above, the locking positions of hinge assembly 145 are dictated by the slot configuration, with FIGS. 15-17 illustrating exemplary slot configuration.

The parts for hinge assemblies 140, 145 can be formed of any conventional material. Preferably, the housing 260, knob 210, and piston 230 are molded from a high strength plastic, the key 220 is zinc die cast, and the extension member or post 250 is a single steel dowel pin. The hinge plates 150 could be a metal, such as aluminum, or steel, or a composite material such as fiberglass and are preferably punched into shape. Assemblies 140, 145 according to the present invention can be assembled separately and then attached to rails to form completed ladder. Particularly where different assemblies 140, 145 are produced having different locking positions (for example by utilizing different slot configurations in hinge plates 150 as described above) various parts of the hinge assembly, for example the knob or the hinge plates, can be color coded to indicate the type of hinge assembly and the particular arrangement of locking positions.

It is to be understood that in alternative embodiments, the hinge plates 150, 150' are attached to the ladder rails prior to formation of assembly 140 and/or are provided as an integral part of the ladder rails. Particularly where the hinge plates are provided as an integral part of the ladder rails, it is contemplated that each ladder rail will include only a single hinge plate.

Figure 18:
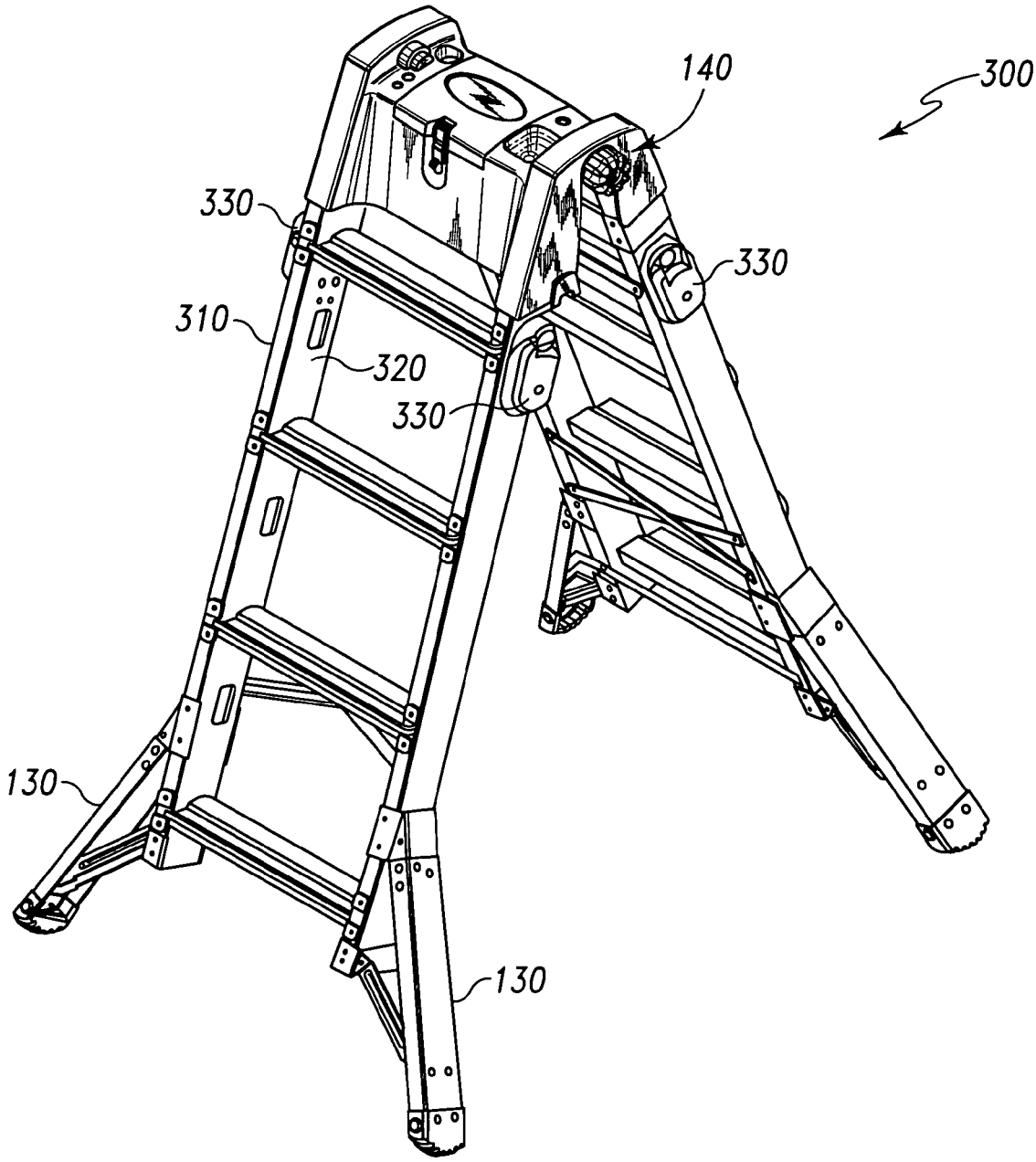
FIG. 18 is a perspective view of an extension stepladder according to an embodiment of the present invention.

Turning now to FIG. 18, a multi-section folding ladder 300, where each of the ladder sections are extendable, is depicted. Ladder 300 is a hinged stepladder similar to ladder 100. However, each of the ladder sections in ladder 300 includes a pair of inner rails 320 slidably nested inside a pair of outer rails 310. Extension locking mechanism 330 is mounted on each of the outer rails near the top portion of the outer rails. As described more fully below, mechanism 330 extends through openings in the outer rails and cooperates with the inner rails to lock the ladder in extended positions.

Figure 19:
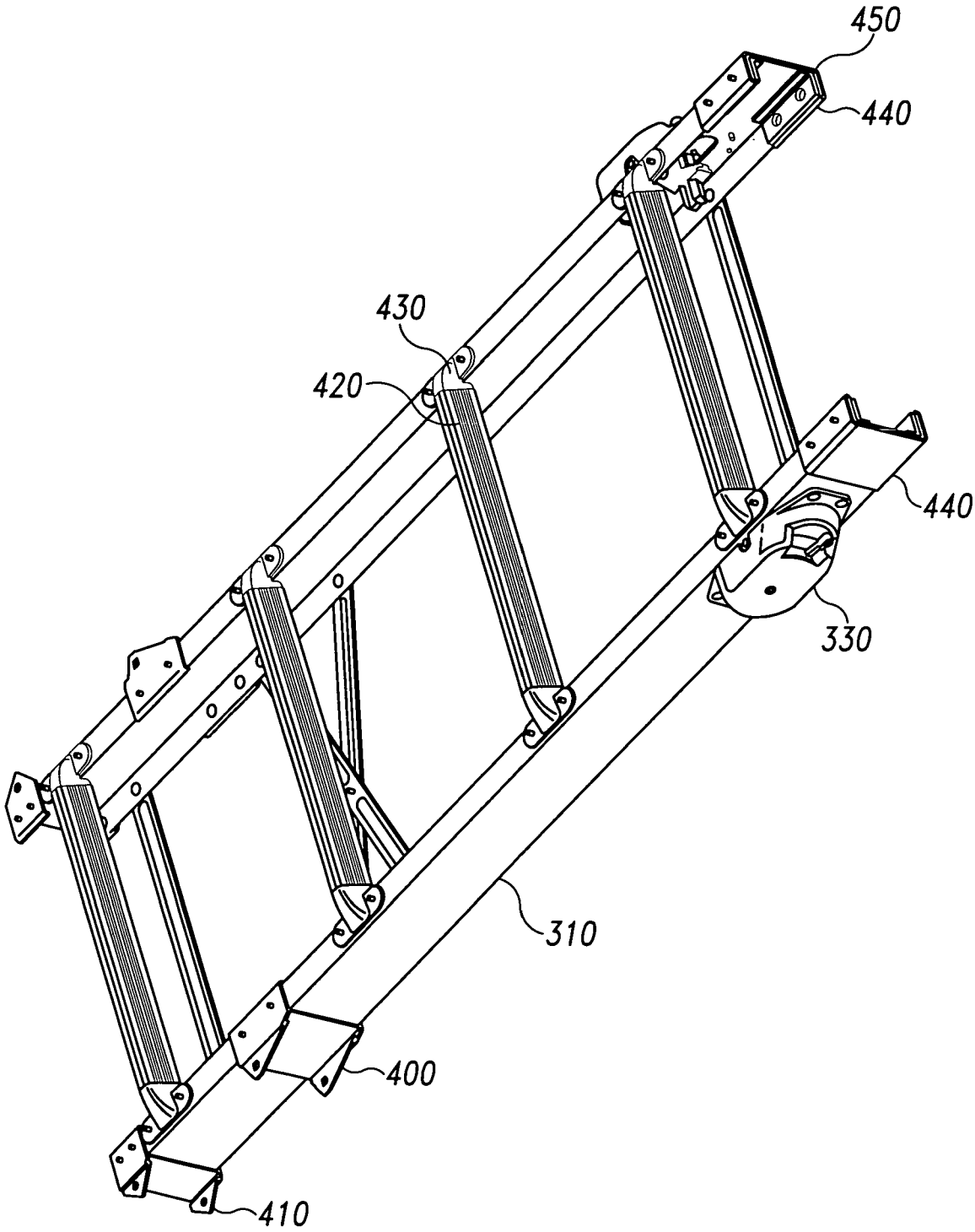
FIG. 19 is a perspective view of the outer rail assembly for the stepladder of FIG. 18.
Figure 26:
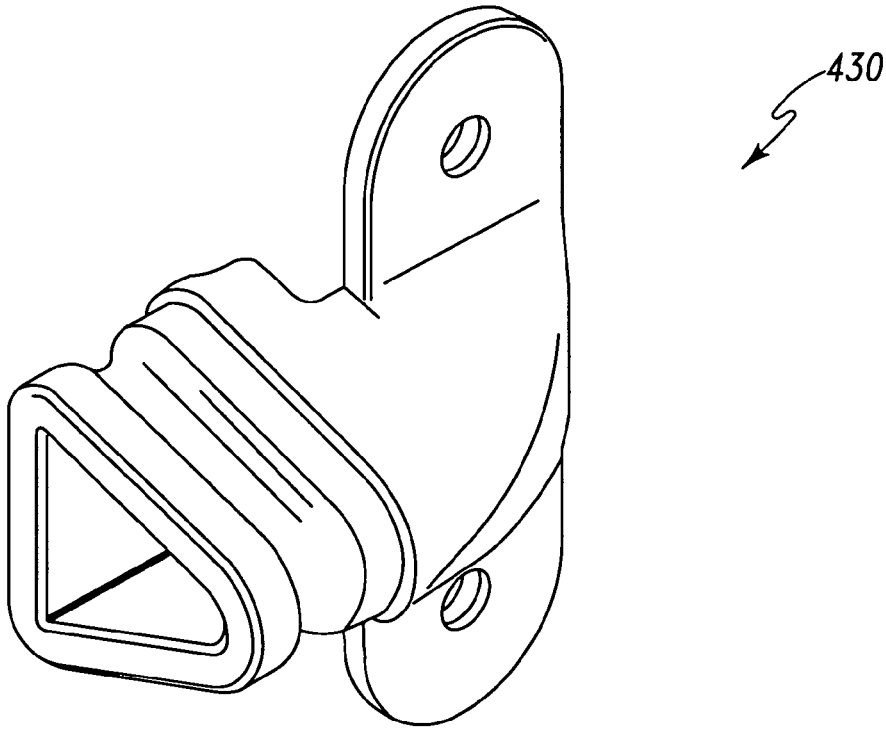
FIG. 26 is a perspective view of the rung connector for attaching the rungs to the outer rails in the FIG. 18 extension ladder.
Figure 27:
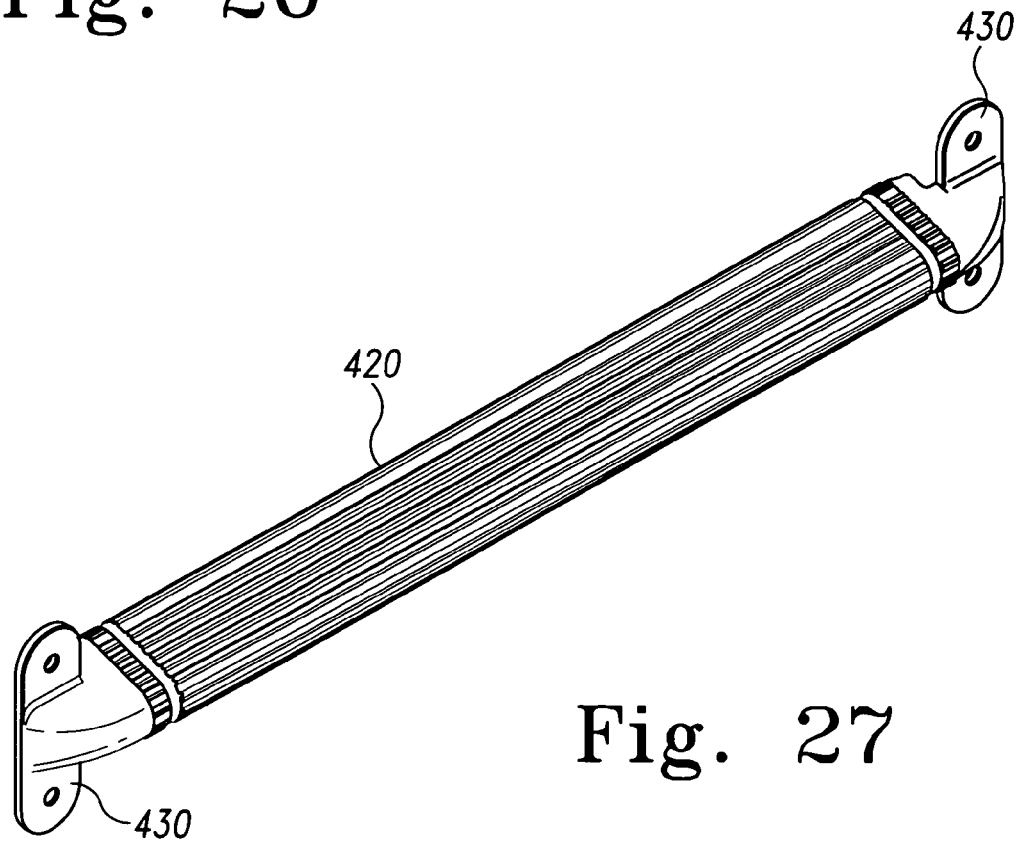
FIG. 27 is a perspective view of a rung crimped to the FIG. 26 connectors.

With reference to FIG. 19, for each of the ladder sections, the outer rail assembly includes a pair of outer rails 310 with a plurality of rungs 420 connected therebetween. The rungs 420 have hollow ends that are inserted over and crimped to ladder connectors 430 (see FIGS. 26 and 27). The connectors 430 are then coupled to the outside of the outer rails 310 via rivets or other suitable connectors. Struts are connected between the rails 310 for additional support.

Figure 28:
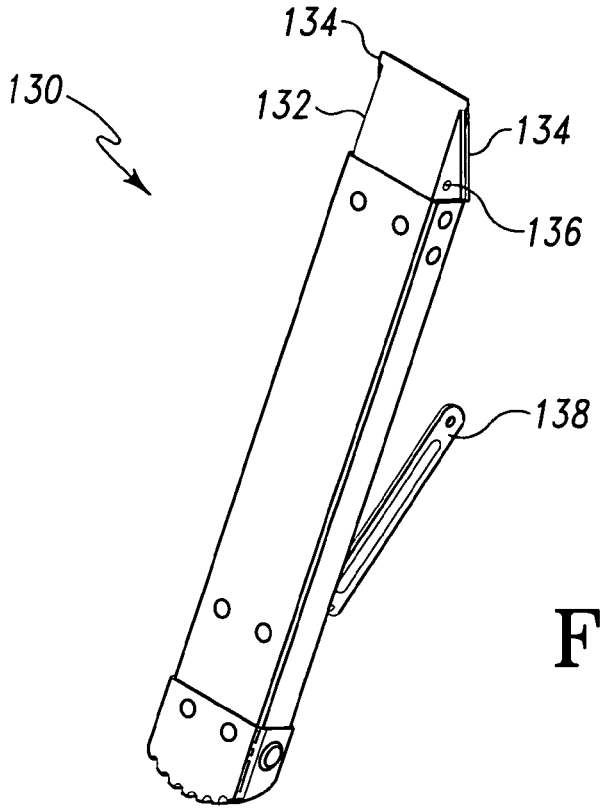
FIG. 28 is a perspective view of the outside of the outrigger assembly for the ladders of FIGS. 1 and 18.
Figure 29:
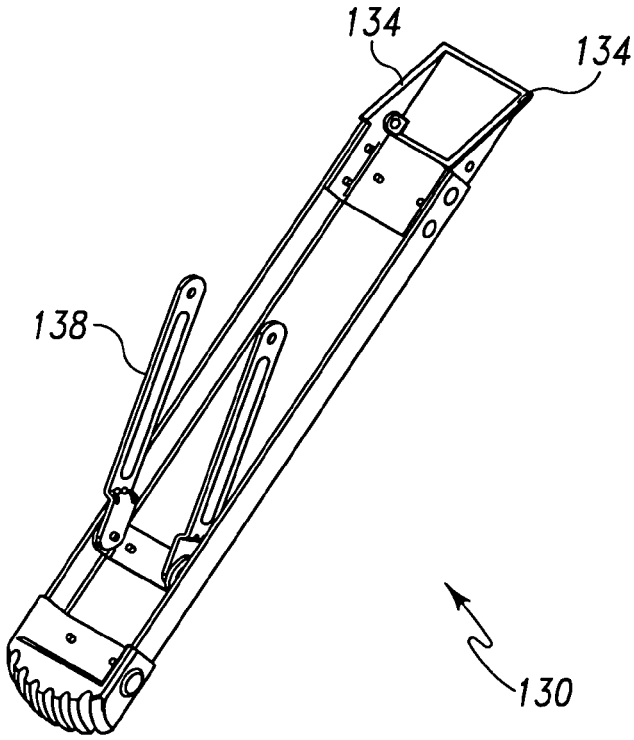
FIG. 29 is a perspective view of the underside of the FIG. 28 outrigger assembly.
Figure 30:
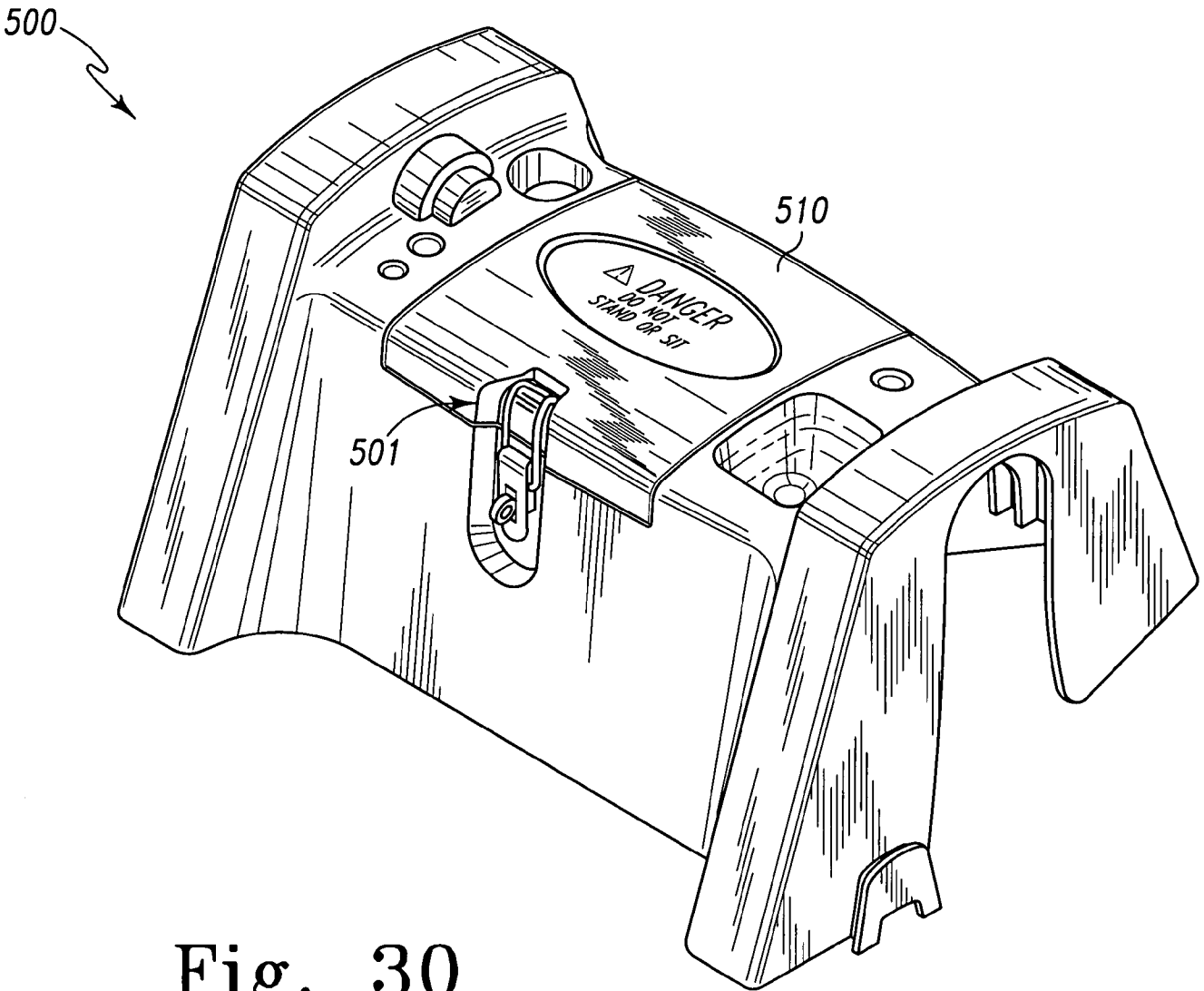
FIGS. 30-37 are views of a step ladder top cap and top cap assembly according to further embodiments of the invention.
Figure 31:
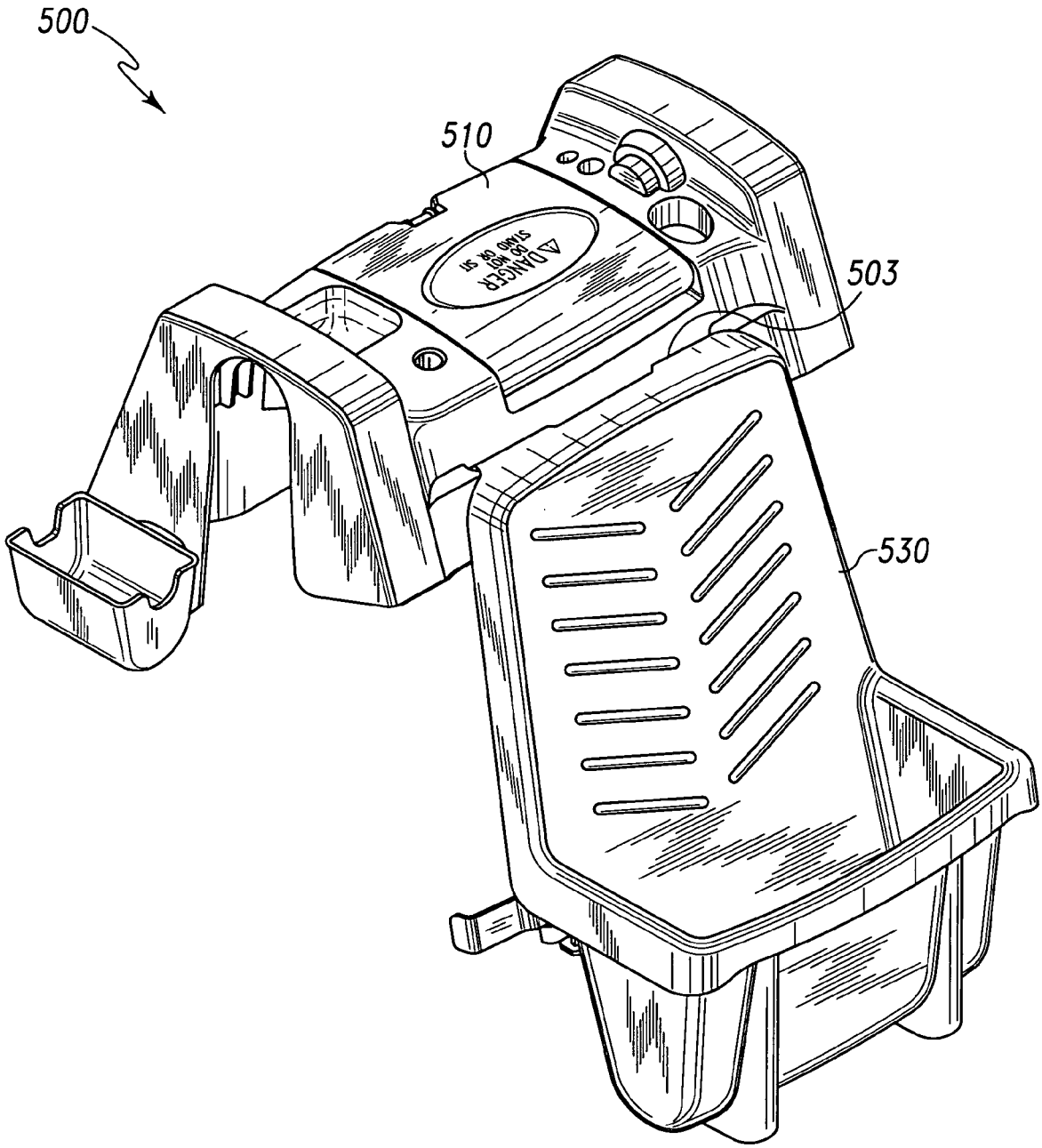
Figure 32:
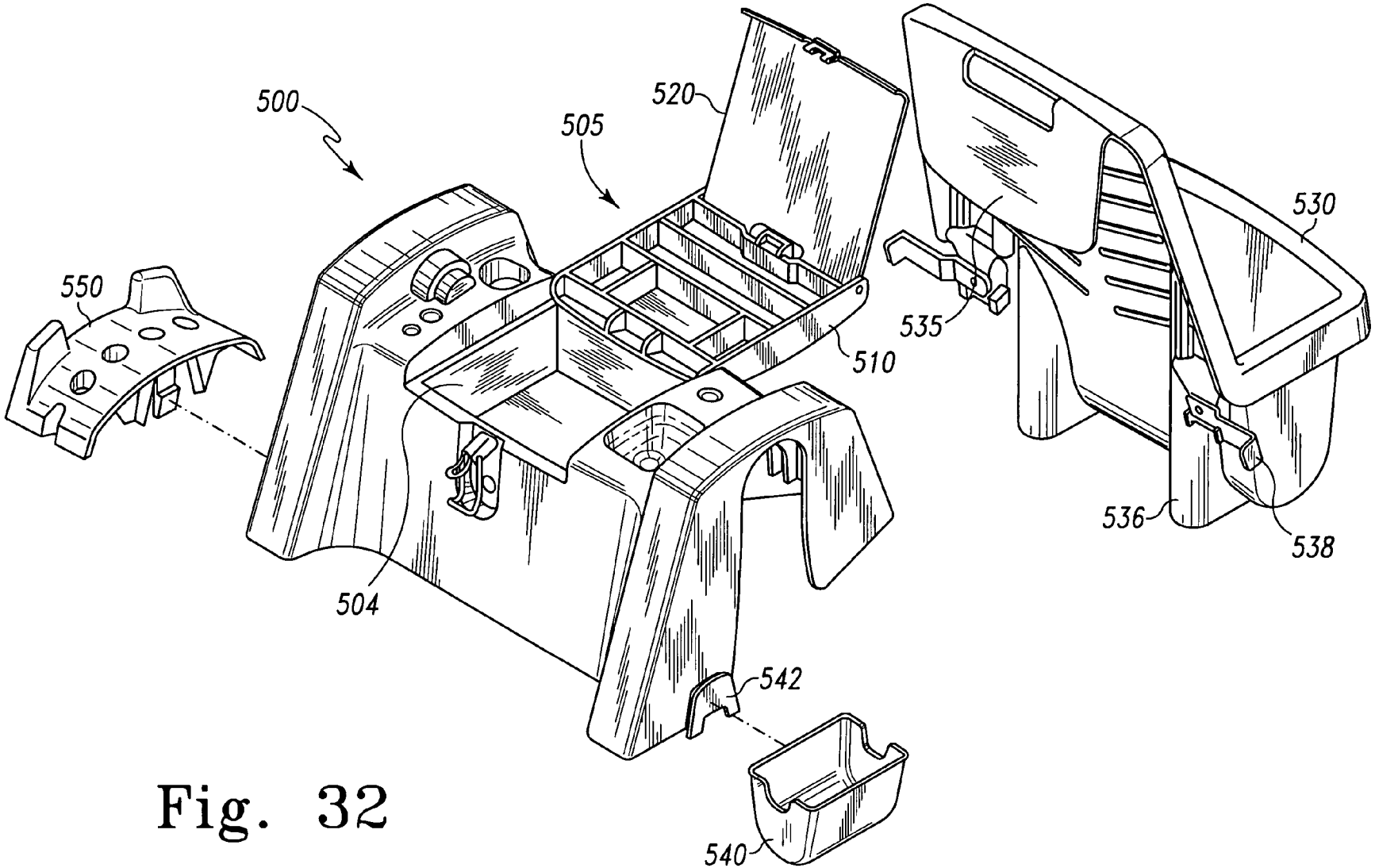
Figure 33:
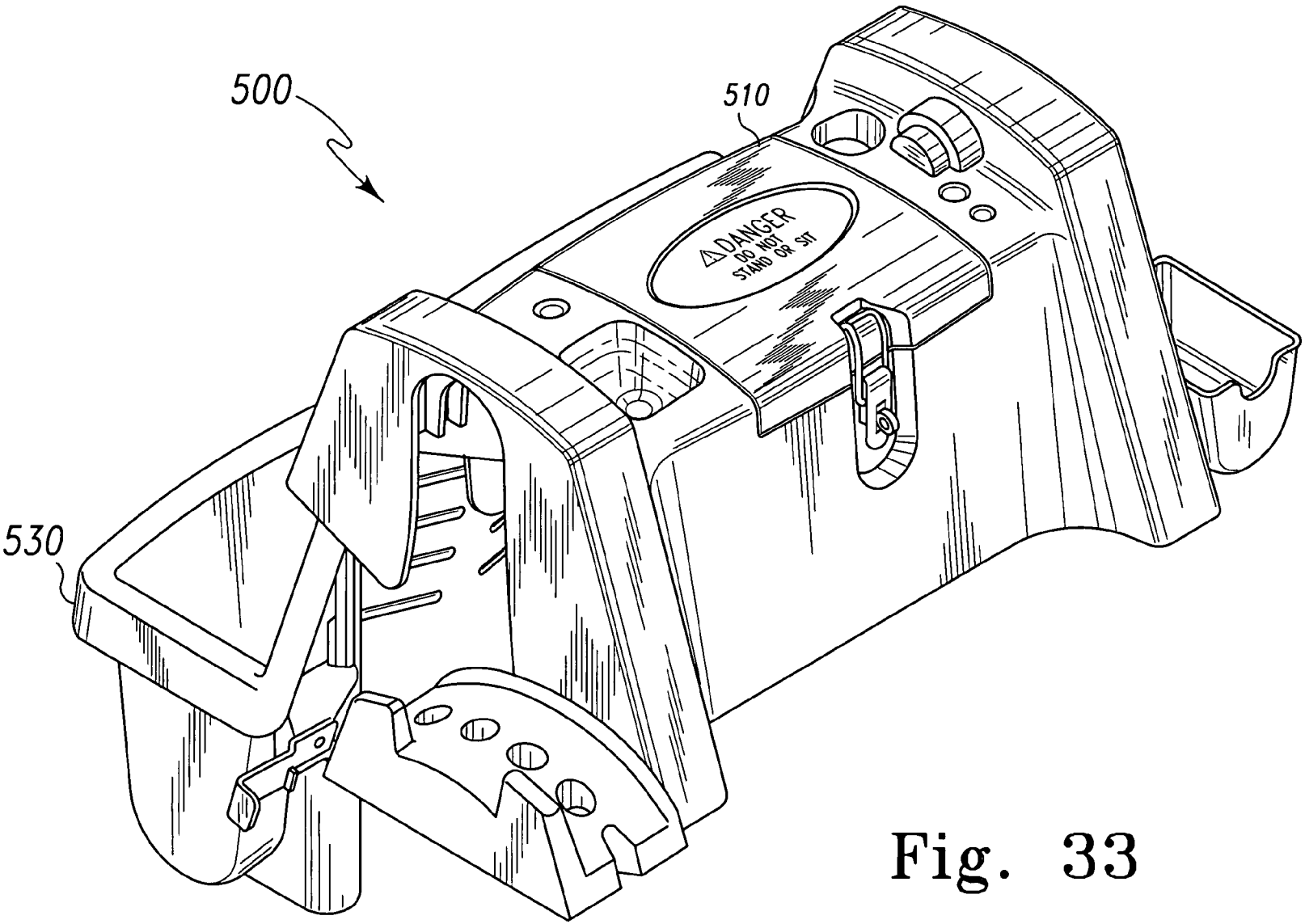
Figure 34:
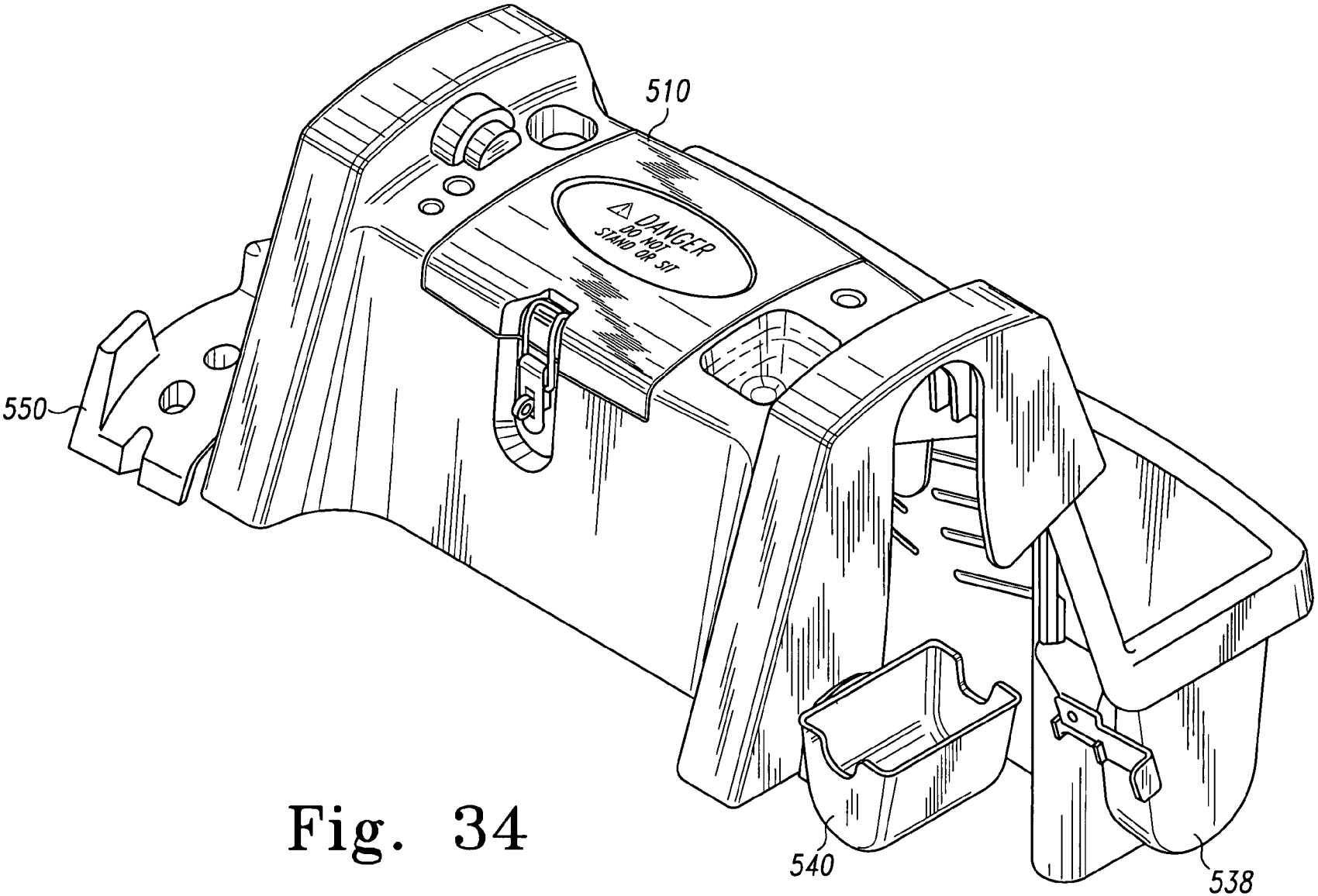
Figure 35:
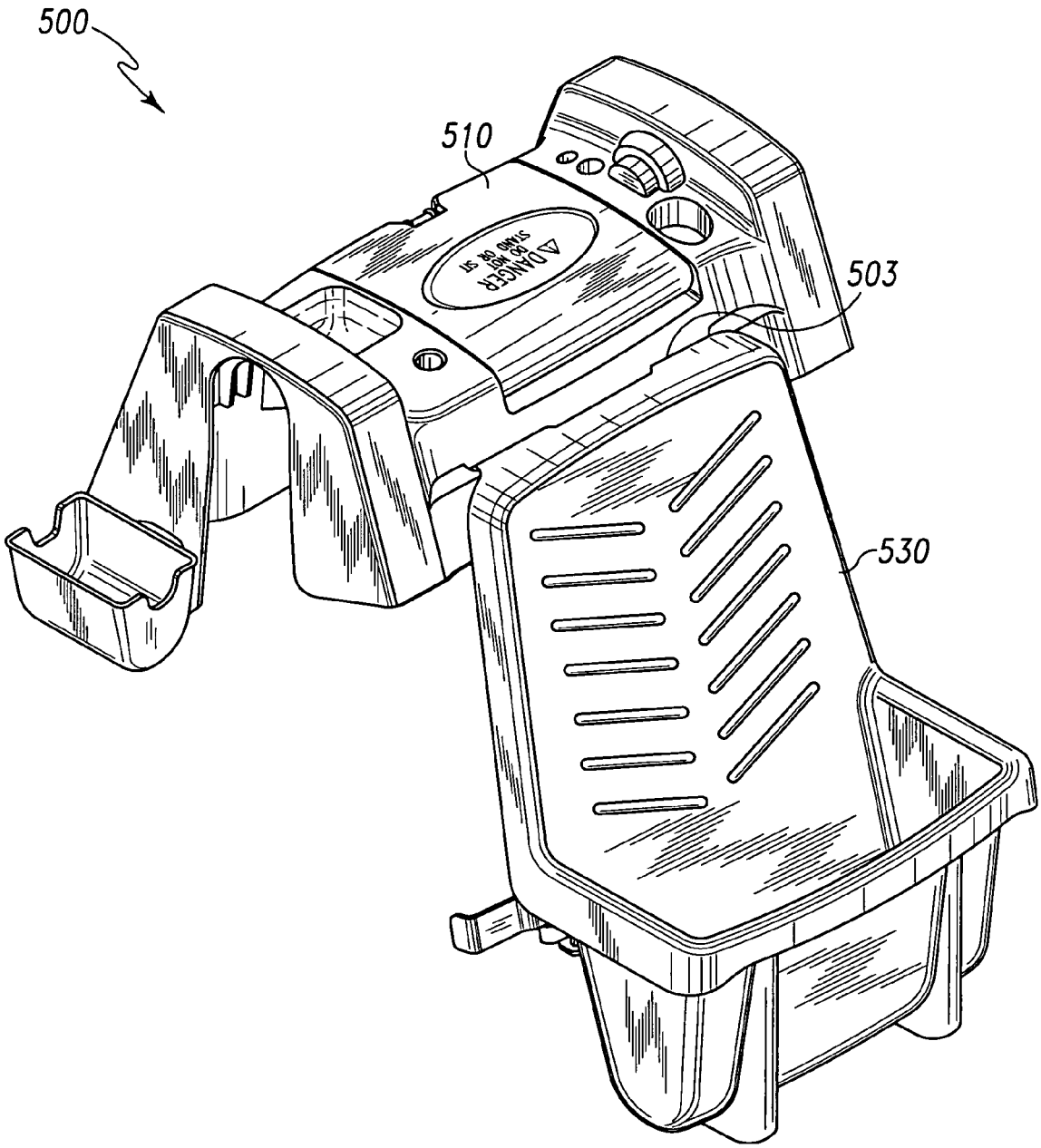
Figure 36:
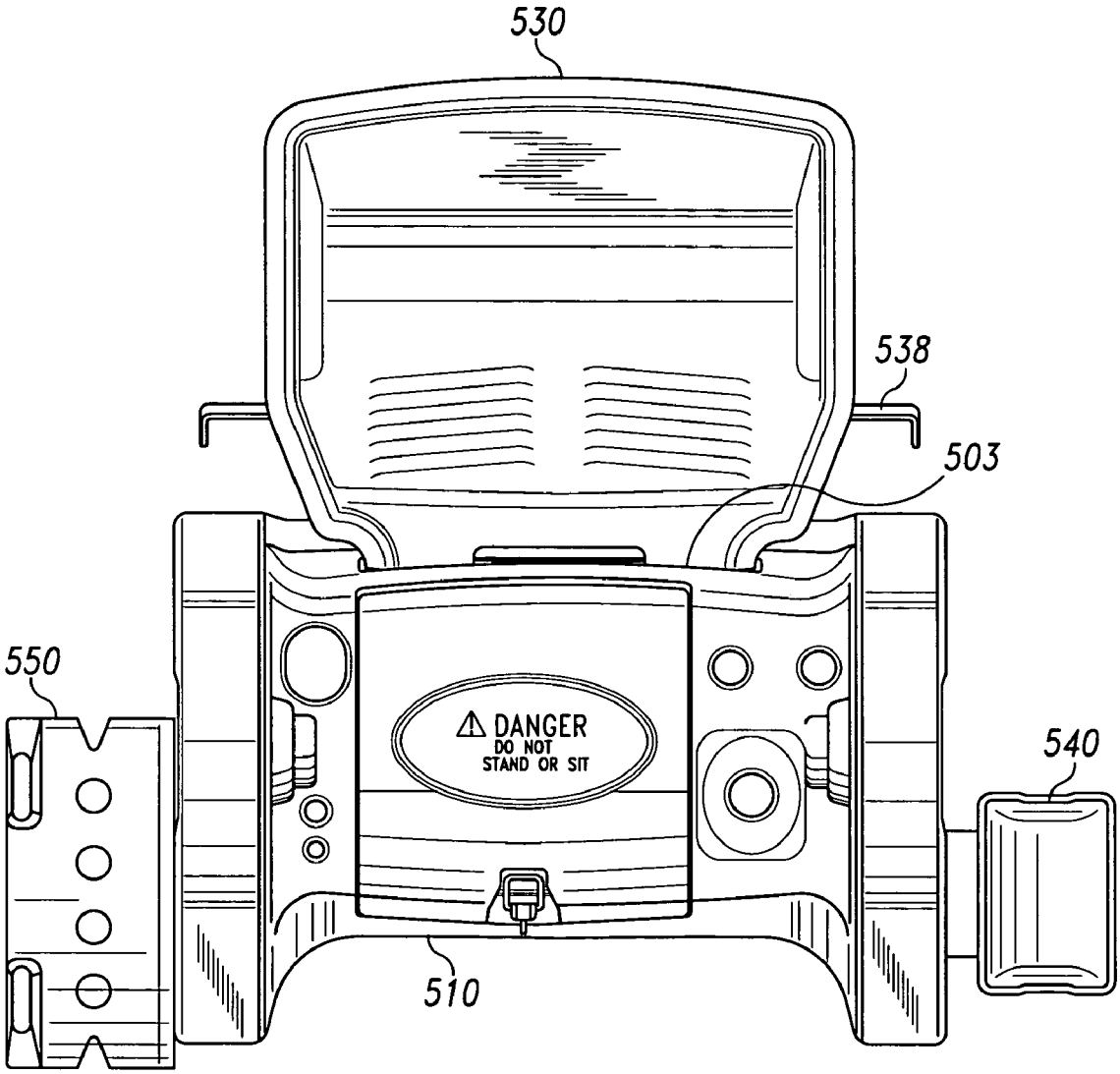
Figure 37:
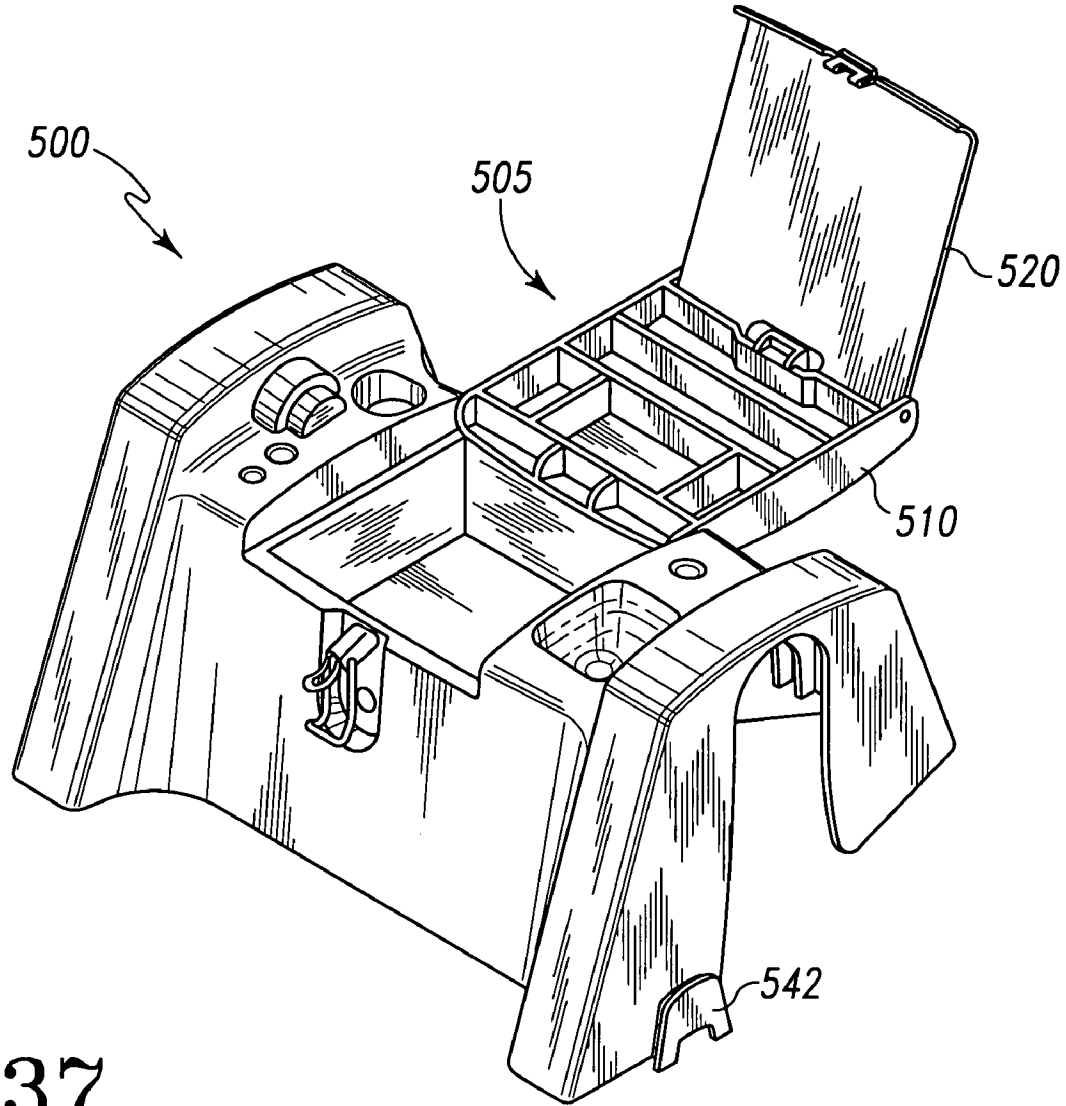

The outer rails 310 define a rectangular channel with the open end of the channel facing the inner rails. The top portion of the outer rails 310 includes bearing pieces 450 on the inner sides of the rectangular channel for guiding the inner rails 320. An outer collar 440 surrounds the outside of the outer rails 310 about the bearing pieces 450. Upper and lower outrigger brackets 400, 410, are also attached to the lower portion of the outer rails 310 and receiving the outrigger 130. The upper bracket 400 includes a pair of outwardly extending members that define a pair of opposed slots adjacent the outer surface of rail 310. The slots are elongated in a direction parallel to the outer face of the outer rail 310. As shown in FIGS. 28 and, the outrigger 130 includes an upper piece having a pair of flanges 134. The flanges 134 are received in the slots defined by bracket 400 so as to orient the outrigger 130 at a supporting angle relative to the rails 310. The outrigger is secured to bracket 400 with a mounting pin, bolt, or similar connector extending through holes 136 and the corresponding holes in bracket 400 such that the mounting pin is transverse to the elongation direction of the slots. Outrigger arms 138 are also coupled to lower bracket via 410 with a second rigid connector such as a pin or bolt.

Figure 20:
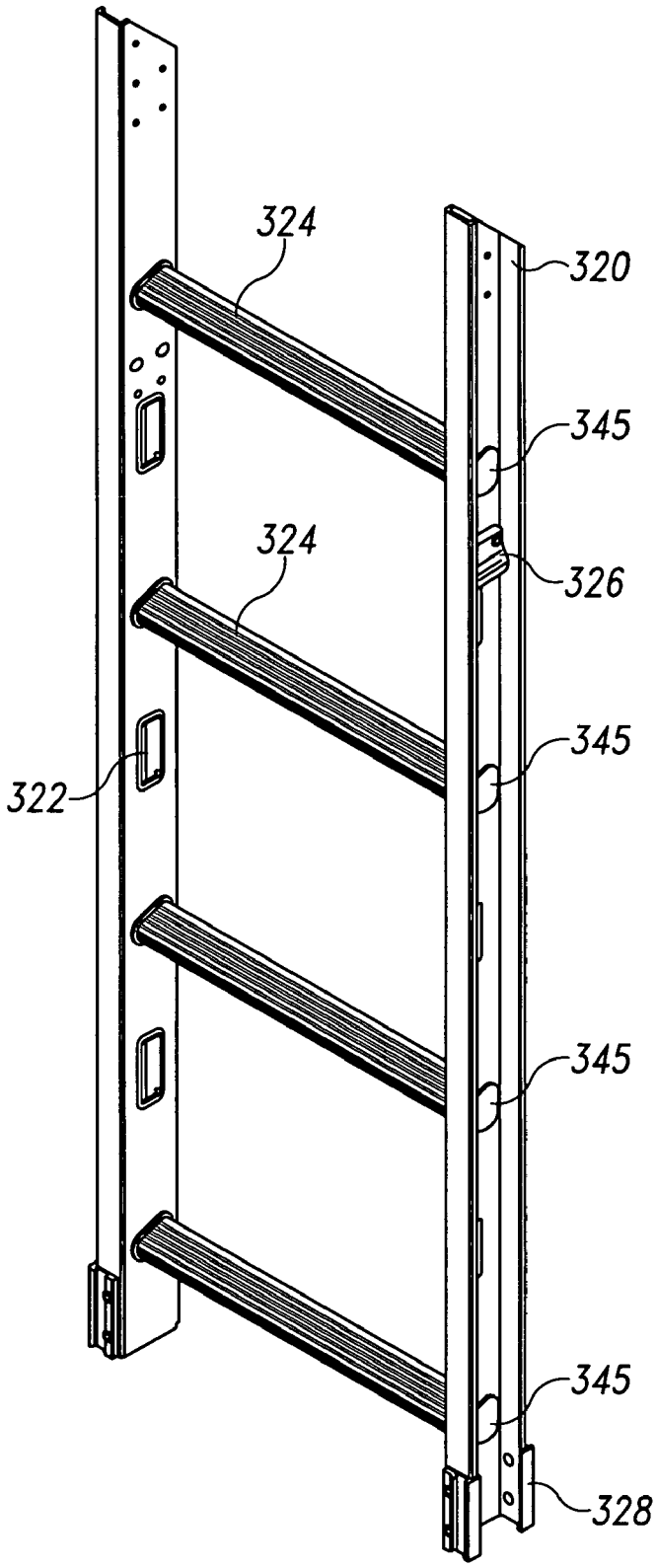
FIG. 20 is a perspective view of the inner rail assembly for the FIG. 18 stepladder.
Figure 21:
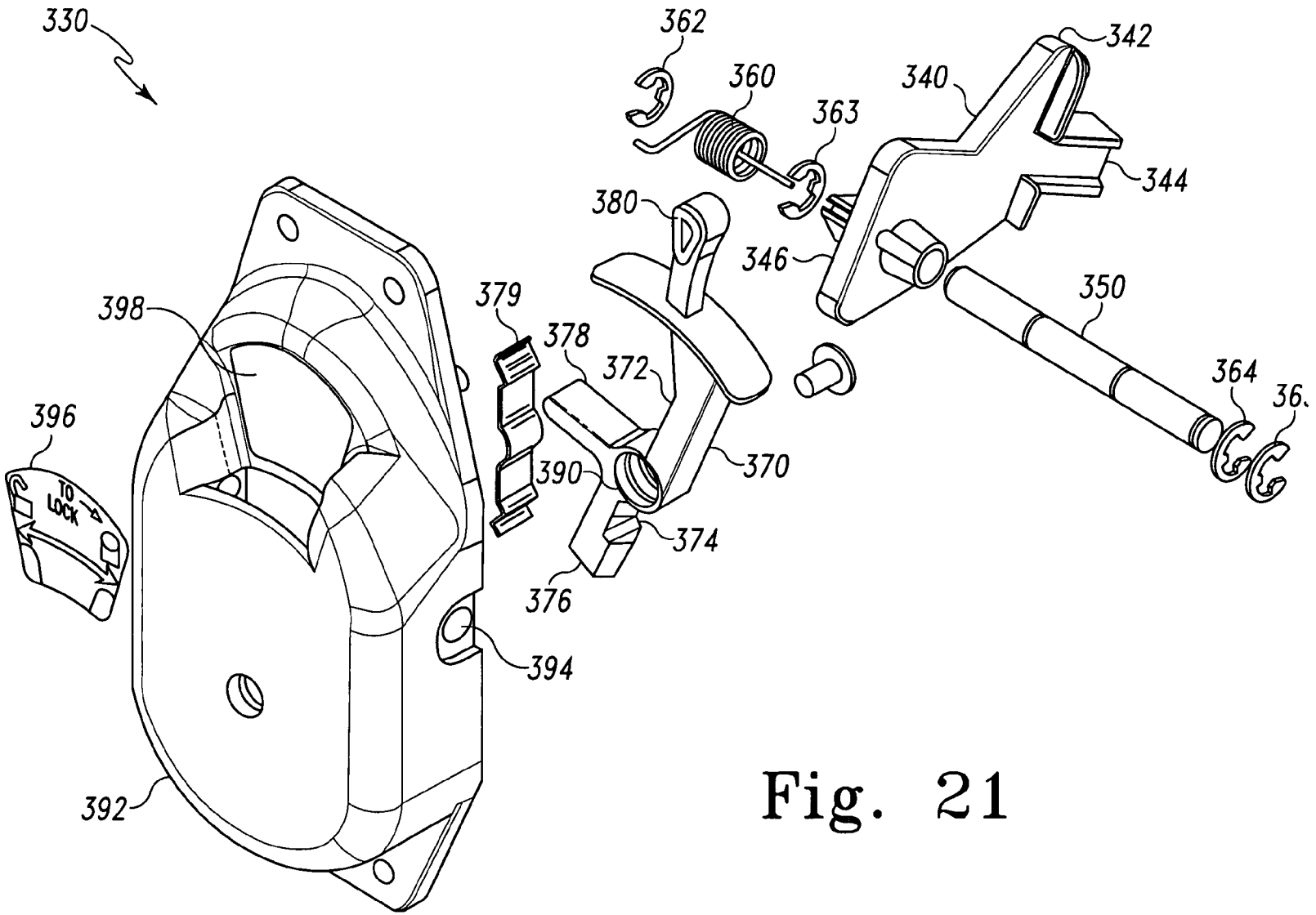
FIG. 21 is a perspective assembly view of the extension latch mechanism of the FIG. 18 stepladder.
Figure 23:
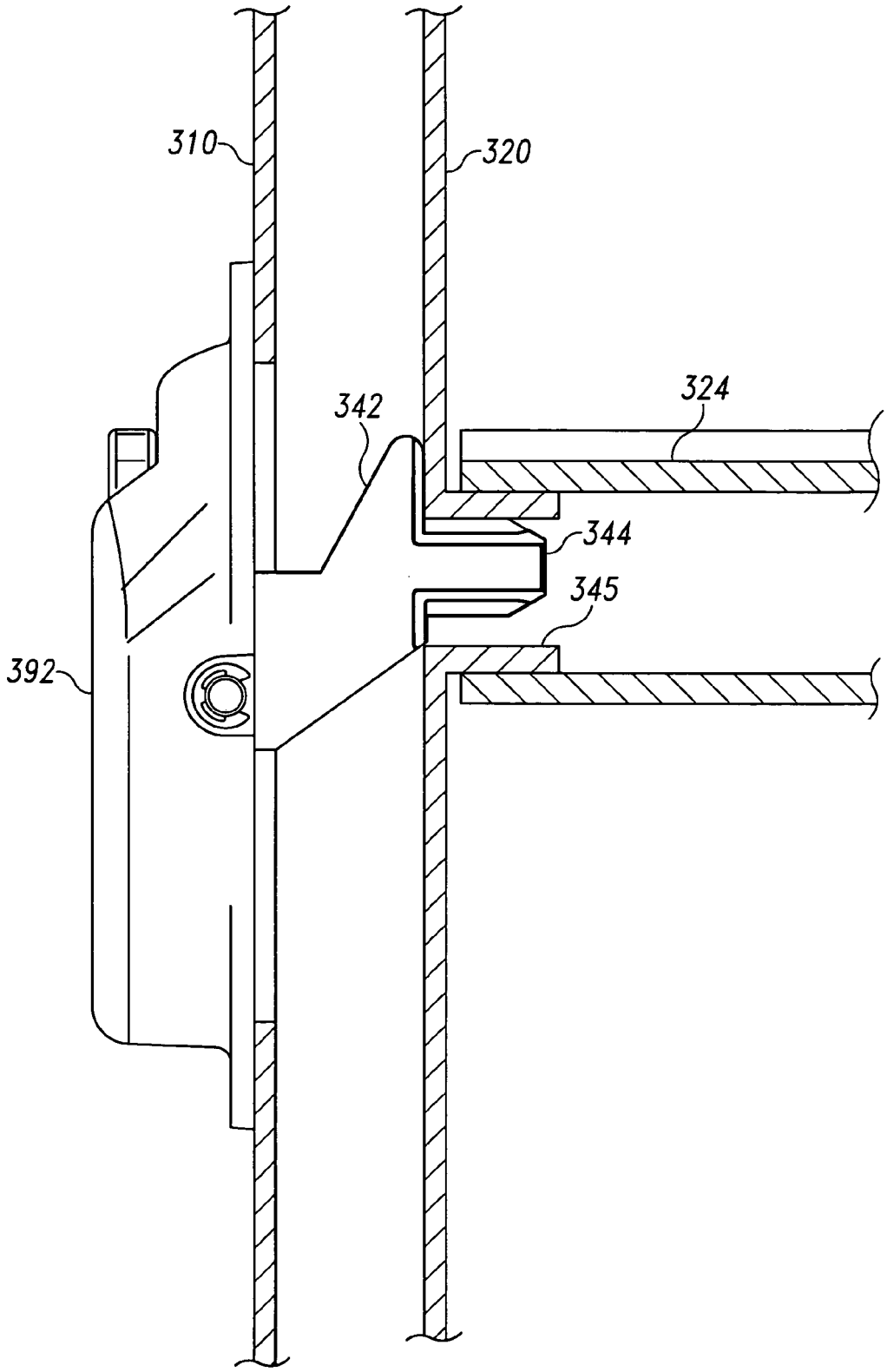
FIG. 23 is a side view in partial section of the FIG. 18 step ladder with the FIG. 21 extension latch mechanism thereon with the pivoting dog of the latch mechanism engaged in the inner rail supporting position.
Figure 24:
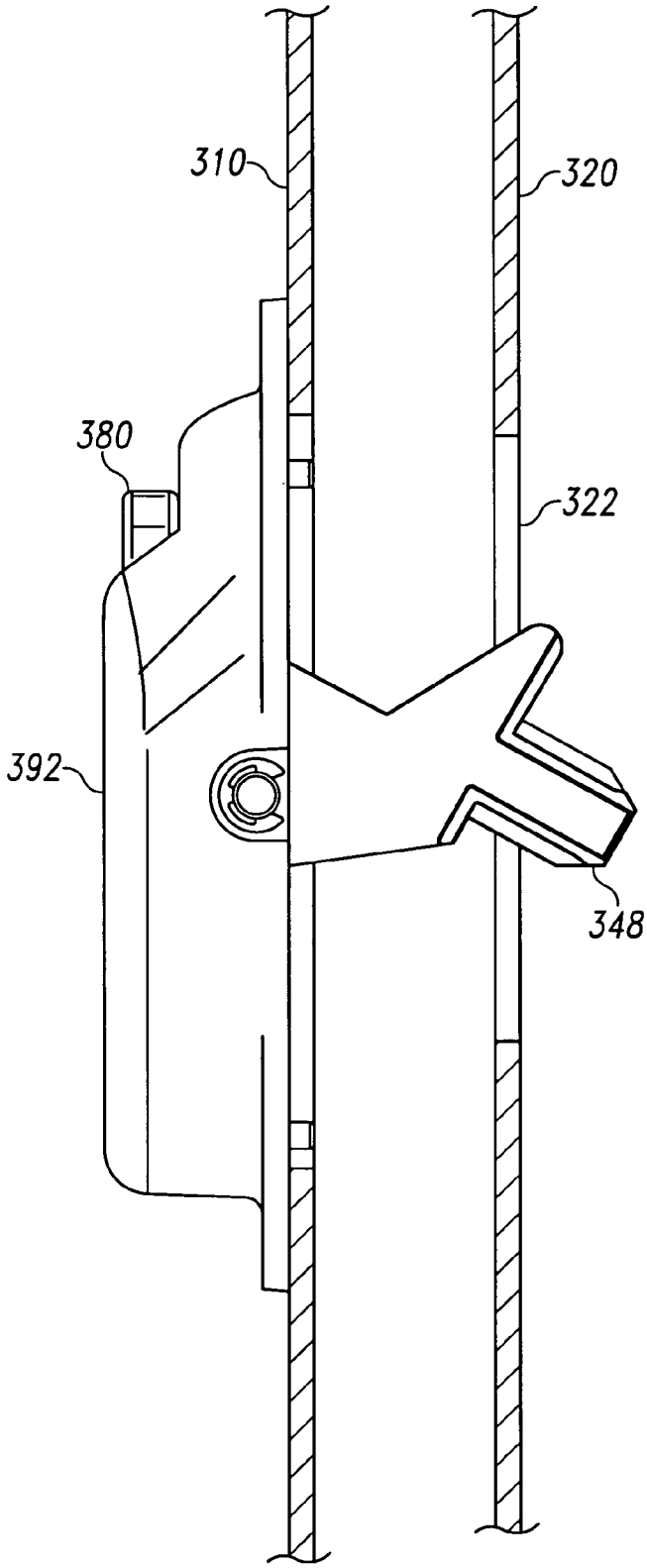
FIG. 24 is a side view in partial section of the FIG. 18 step ladder with the FIG. 21 latch mechanism thereon with the pivoting dog in the resting position extending through the inner rail slots between the ladder rungs.

With reference to FIG. 20, the inner rail assembly includes a pair of inner rails 320 each defining a rectangular channel with the open end of the channel facing the open end of the channel of the outer rail 310. Bearing pieces 328 are attached to the outside bottom of the inner rails 320 for guiding contact with the inside channel surface of the outer rails 310. Rungs 324 are attached between the rails 320, and a locking piece 326 is mounted inside the rectangular channel of the rails at a level just below the level of the top rung 324. The inner rails 320 define slots 322 between the rungs 324 and locking openings 345 in communication with the hollow ends of the rungs 324. (See FIG. 23) As shown in FIG. 23, the locking openings 345 communicate with rungs 324 and provide a site to which the rungs 324 can be crimped, welded, or otherwise attached. In alternative embodiments, and particularly though not exclusively where openings 325 are separate from rungs 324, rungs 324 can be attached to rails 320 in any conventional fashion.

Turning now to FIGS. 21-25, more particular features of the latch mechanism 330 are illustrated. Latch mechanism 330 includes a dog 340 pivotally mounted inside a housing 392. Dog 340 defines an upwardly extending abutment 342, a horizontally extending portion 344, and a locking surface 346. A pivot pin 350 extends through a hole in dog 340, and dog 340 is maintained at the center of pin 350 by clips 363, 364. Pin 350 is mounted in holes 394 in housing and held therein with clips 362, 365. Return spring 360 engages in a slot in dog 340 and one in housing 392 to bias dog 340 to the resting position of FIG. 24. Housing 392 is riveted to the outer surface of outer rail 310 so as to have pivot pin 350 generally perpendicular to both the elongated axis of rungs and the extension and retraction direction of rails 310, 320. Accordingly, it is to be understood that the ladder rails 310, 320 extend and retract generally in the pivot plane of dog 340.

A locking bar 370 is pivotally mounted in the back face of the housing 392 behind the pivot pin 350. The bar 370 includes an upper locking portion 372 and a lower locking portion 376. Portions 372 and 376 extend from the mounting hole 390 in opposite directions and each are offset from the pivot axis, which axis is defined by the mounting hole 390. A lever portion 380 extends outside the housing 392 such that the bar 370 can be pivoted by an operator. Bar 370 includes a position locking portion 378 extending laterally from hole 390. Portion 378 engages with a leaf spring 379 provided in housing 392 to retain bar 370 in either a first position (FIGS. 22A-22C) or a second position. An outside face 398 of the housing 392 includes a sticker 396 having a pair of icons for indicating either a locked or unlocked position. Lever portion 380 covers one of the icons in each of the two positions, thereby providing a visual indication of whether the mechanism 330 is in the locked or unlocked position.

The latch mechanism operates in conjunction with the inner 320 and outer rails 310 to hold the ladder in one of a variety of extended positions. An exemplary extended position is illustrated in FIG. 23. In the extended position shown in FIG. 23, the horizontally extending portion 344 of dog 340 engages in the locking opening 345 in the inner rail 320 with the upwardly extending abutment 342 in contact with a corresponding bearing surface of the inner rail 320. There is a latch mechanism on each side of the ladder. Accordingly, the weight of the ladder and any load thereon creates a moment about the pivot axis of the dogs 340 which moment is resolved by the upwardly extending abutments 342 bearing inwardly against the inner rails 320 to prevent the ladder from collapsing (being retracted) when an operator steps onto the rungs.

Figure 22C:
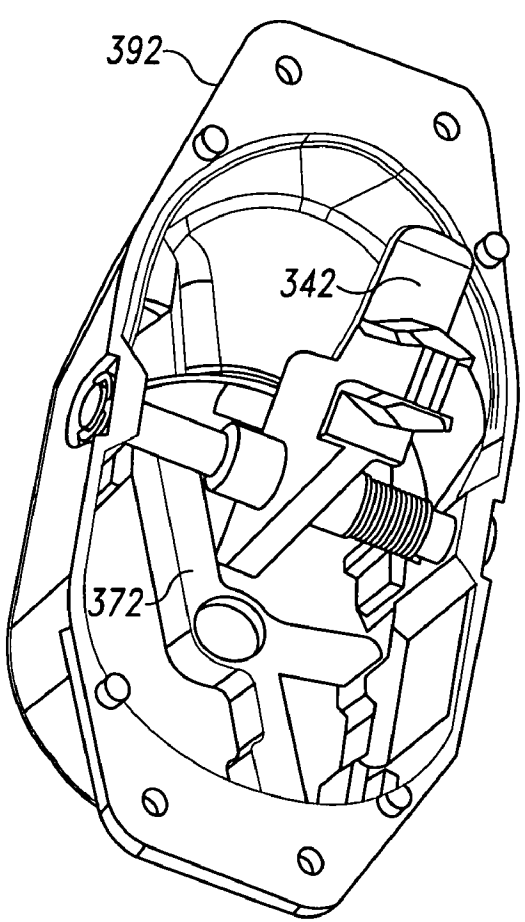
FIGS. 22A-22C are perspective views of the extension latch mechanism of FIG. 21.
Figure 22B:
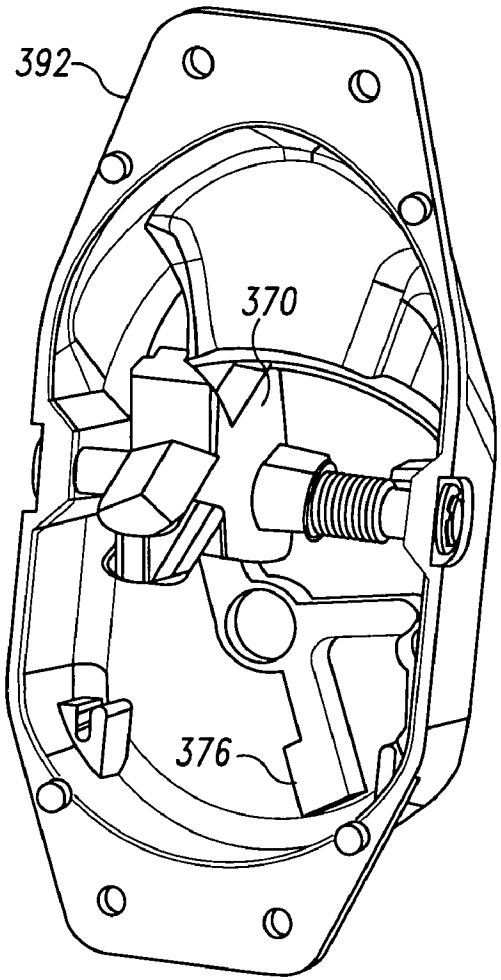
Figure 22A:
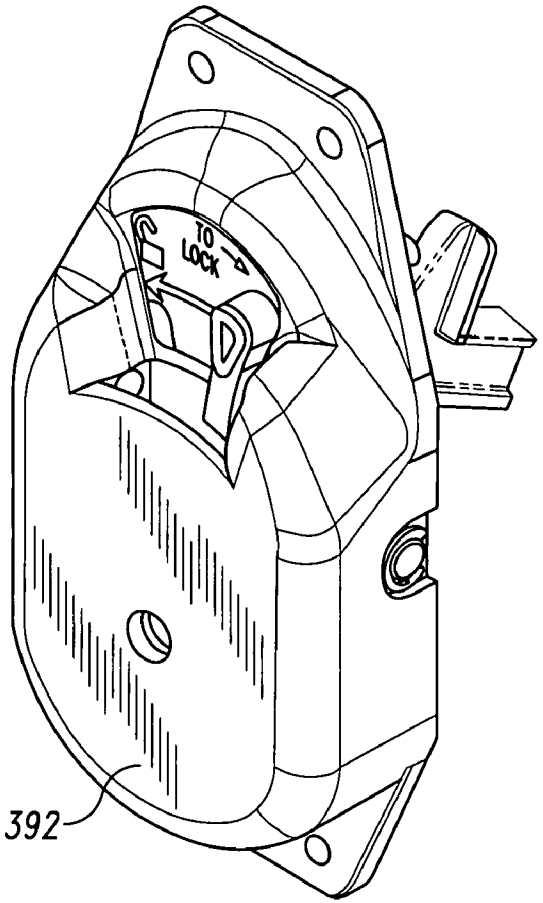

It is to be understood that the ladder is placed into the extended position of FIG. 23 by extending the inner rails 320 relative to the outer rails 310, with latch mechanism in the unlocked position of FIGS. 22A-22C. As the inner rails 320 are extended, the dog 340 pivots in the space between the rails 310, 320. Because the latch mechanism is in the unlocked position, upper portion 372 of locking bar 370 is removed from the pivot plane of the dog 340 and does not contact locking surface 346. When the dog 340 is seated in opening 345 in the rail supporting position of FIG. 23, the locking surface 346 of dog 340 is generally vertical and parallel to the pivot plane of the locking bar 370. The locking bar 370 is then moved to the locked position in which the upper portion 372 of bar 370 is immediately behind the locking surface 346 of dog 340 and in the pivot plane of dog 340. Accordingly, in the locked position, bar 370 is generally in surface engagement with locking surface 346 so as to prevent further pivoting of dog 340. Because the dog 340 cannot pivot when the locking mechanism is the locked position, the ladder cannot be further extended, thereby allowing an operator to lift the ladder by the inner rails without extending the ladder further. In addition, if the dog 340 is not properly seated in locking opening 345, locking surface 346 will not be parallel to upper portion 372 of locking bar 370, thereby preventing locking bar 370 from being moved to the locked position. Accordingly, the ability to move locking bar 370 to the locked position provides the operator with an indication that the dog 340 is properly seated in the locking opening 345.

To retract the ladder rails, the locking bar 370 is moved to the unlocked position. The inner rails are then further extended, with horizontally extending portion 344 of dog 340 pivoting upwardly out of opening 345. The inner rails are raised at least until the dog 340 reaches the next slot 322 in the inner rails 320. Slot 322 is sized such that as dog 340 is able to assuming its resting position under the force of return spring 360, in which both the upwardly extending abutment 342 and the horizontally extending portion 344 of dog 340 extend into and partially through slot 322. (FIG. 24) The ladder can then be fully retracted, with the dog 340 pivoting downwardly as abutment 342 contacts the inner rail 320 at the upper boundary of slot 322.

Figure 25:
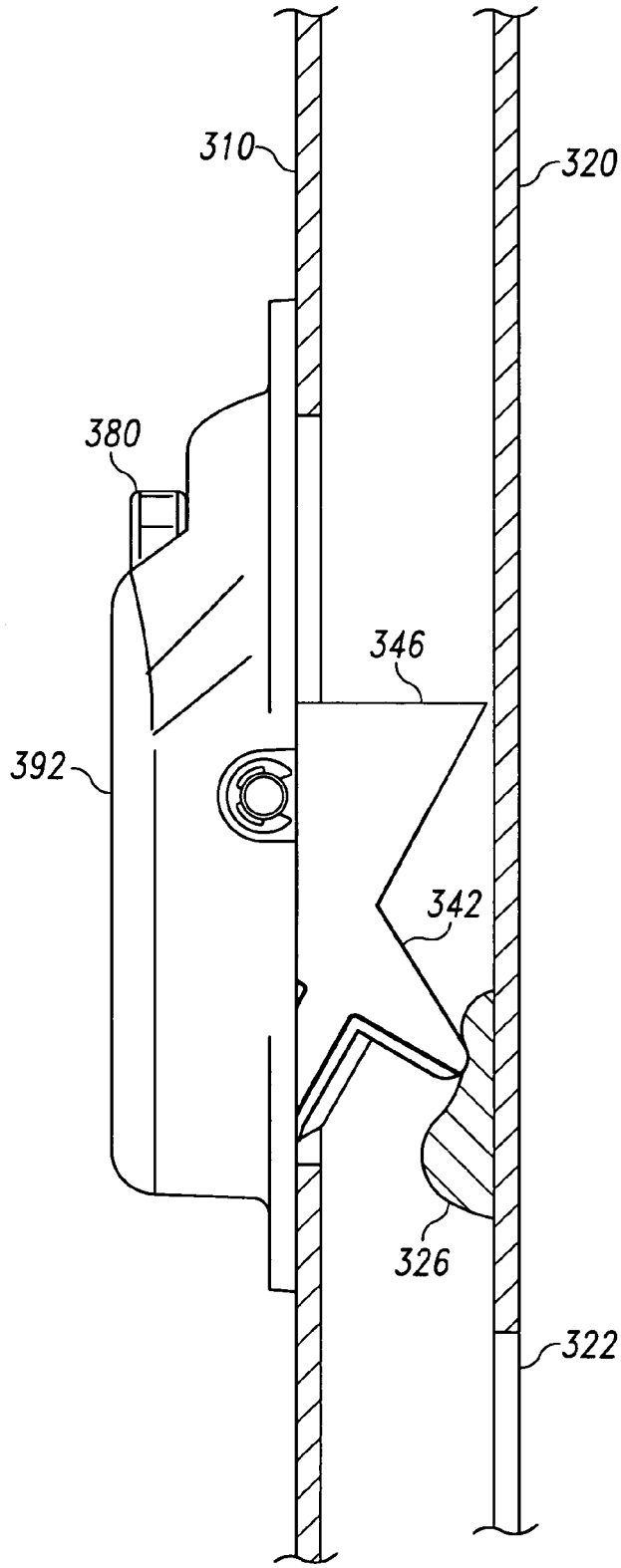
FIG. 25 is a side view in partial section of the FIG. 18 step ladder with the FIG. 21 latch mechanism thereon with the pivoting dog engaged with the locking member on the inner rail in the secondary locked position.

When fully retracted, abutment 342 encounters locking member 326 on inner rail as depicted in FIG. 25. Locking member 326 has a lower portion that extends from the inside surface of the inner rail towards the outer rail. As abutment 342 passes over the lower portion of locking member 326, lower surface 348 of dog 340 is pivoting adjacent the lower portion 376 of locking bar 370, which is in the unlocked position. When in the fully retracted position of FIG. 25, the locking bar 370 can then be moved to the locked position, preventing the dog 340 from pivoting as required to pass back over the member 326 and thereby locking the ladder in the retracted position for ease of transport.

It is to be understood that same latch mechanism 330 can be used on each side of the ladder. Preferably, for an opposed pair of latch mechanisms, the locking bar 370 in one of the pair is relatively reversed such that each latch mechanism 330 is placed in the locked or unlocked position by flipping the respective levers 380 in the same direction relative to the operator, who would be standing facing a ladder section with a latch mechanism 330 on his right and left sides. When locking bar 370 is reversed, spring clip 379 is placed into corresponding mounts on the other side of housing 392 and the sticker 396 reverses the icons. Furthermore, in the illustrated embodiment, the top surface of rungs 324 are angled relative to the extension and retraction direction or rails 310, 320 so as to be parallel to the ground when the ladder 300 is opened in the operational position (see FIG. 18). Accordingly, the top and bottom surface of horizontally extending portion 344 of the dog defines a pair of angled surfaces that each correspond to the angle of the top surface of the rung 324 relative to the pivot plane of the dog 340 when the dog is used in a mechanism 330 on either side of the ladder 300. The distal end of horizontally extending portion 344 also is tapered to facilitate movement into and out of locking opening 345.

The components of ladder 300 and latch assembly 330 can be formed of any suitable material, such as molded plastic, metals, or composite materials such as fiberglass. For example, the rails 310, 320 and outrigger 130 can be fiberglass, the dog 340 can be die cast metal, the lever 370 and the housing 392 can be molded plastic.

Turning now to FIGS. 30-37 a top cap assembly for the step ladder according to the present invention is illustrated. The top cap 500 is a molded plastic piece that fits over the top of a step ladder and has a pair of slots down the slides for receiving hinge assemblies 140. The top portion of the top cap is generally flat and defines a plurality of recesses for receiving tools. The center of the top portion also includes a compartment 504 (FIG. 32) covered by a hinged main lid 510. The hinged lid 510 encounters a positive stop when opened 180 degrees to reveal a second lid 520 on the underside of the main lid. The second lid 520 is opened to reveal a plurality of compartments 505 formed in the underside of the main lid 510. The main lid 510 includes a latch 501 such that main lid 510 can be locked shut.

The front side of the top cap 500 includes a slot 503 (FIGS. 31, 35, 36) that receives a corresponding flange 535 of a vertical paint tray 530 for removably mounting the paint tray 530 thereto. The vertical paint tray 530 has a pair of supports 536 on its base such that, when removed from the top cap 500, the paint tray 530 can be placed on the ground in the same vertical position. The paint tray 530 also includes a pair of rail brackets 538 extending from the back sides of the tray. The rail brackets 538 contact the front and sides of the ladder rails of a ladder section to brace the tray against the ladder and to provide lateral support for the tray during use. The sides of the top cap 500 include means for removably mounting accessories such as the container 540 on the right side and the hose or cord support 550 on the left side. The means for mounting can be any conventional means, such as slots, clips, or press fit type engagements. For example, container mount 542 is a bracket for a press fit type engagement. Top cap 500 could optionally be provided with holes for receiving mounting screws for removable attachment of accessories.

While the invention has been illustrated and described in detail in the drawings and foregoing description, the same is to be considered illustrative and not restrictive in character, it being understood that only the preferred embodiment has been shown and described and that all changes, equivalents, and modifications that come within the scope of the invention described herein or defined by the following claims are desired to be protected. In reading the claims, words such as "a", "an", "at least one", and "at least a portion" are not intended to limit the claims to only one item unless specifically stated to the contrary. Further, when the language "at least a portion" and/or "a portion" is used, the claims may include a portion and/or the entire item unless specifically stated to the contrary.

What is claimed is:

1. A ladder hinge assembly comprising:

a first ladder hinge plate defining a first plate opening and at least one first locking slot in communication therewith;

a second ladder hinge plate defining a second plate opening and at least one second locking slot in communication therewith;

a housing extending through the first and second plate openings, wherein the housing is associated with the first plate and the interior of the second plate opening bears against the exterior of the housing to provide a rotation axis for the plates, and wherein the second plate is operable to rotate relative to the first plate about the rotation axis to selectively align first and second locking slots;

a key outside the housing operable to engage aligned slots to prevent relative rotation of the plates about the rotation axis when the key is engaged with the aligned slots;

a manual rotation member operably coupled to the key to selectively disengage the key from at least one of the aligned slots by rotation of the member a predetermined amount from a rotation member resting position; and a biased piston inside the housing and operably associated with the key to bias the key into engagement with aligned slots of the plates;

wherein the manual rotation member is operably associated with the piston to rotate the piston relative to the housing, the piston including a first bearing surface for operable contact with a second bearing surface of the housing when the manual rotation member is rotated, wherein at least one of the first and second bearing surfaces is a ramped surface and rotation of the manual rotation member is operable to cause rotational and translational relative movement of the piston and the housing.

2. The ladder hinge assembly of claim 1 wherein the predetermined amount is less than 180 degrees.

3. The ladder hinge assembly of claim 1 wherein the ramped surface is ramped at an angle of greater than 15 degrees.

4. The ladder hinge assembly of claim 1 wherein the housing is integrally formed.

5. The ladder hinge assembly of claim 1 further comprising at least one biased plunger operably associated with the piston and the housing to yielding hold the piston and the housing in a relative orientation to maintain the key out of engagement with at least one slot.

6. The ladder hinge assembly of claim 5 wherein the plunger is on the piston and is biased to engage an opening in the housing.

7. The ladder hinge assembly of claim 6 further comprising a cam operably associated with the second ladder hinge plate and including a cam surface operable to dislodge the plunger from the opening in the housing when the hinge plates are rotated a predetermined amount.

8. The ladder hinge assembly of claim 1 in combination with ladder rails wherein the ladder hinge plates are operably associated with a pair of the ladder rails to form a hinged ladder.

9. The ladder hinge assembly of claim 1 in combination with ladder rails wherein the hinge plates are attached to the ladder rails to form a hinged ladder.

10. A ladder hinge assembly comprising:

a first ladder hinge plate defining a first plate opening and at least one first locking slot that extends entirely through the first ladder hinge plate;

a second ladder hinge plate defining a second plate opening and at least one second locking slot;

a housing associated with the first plate and extending through the first and second plate openings, wherein the second plate is operable to rotate relative to the first plate about a rotation axis defined by the housing to selectively align first and second locking slots;

a key translatable in a direction substantially parallel to the rotation axis of the plates to selectively engage the slots when aligned to prevent relative rotation of the plates about the rotation axis when the key is engaged with the aligned slots; and a manual rotation member operably coupled to the key to selectively disengage the key from at least one of the aligned slots by rotation of the rotation member a predetermined amount from a rotation member resting position; and a biased piston inside the housing and operably associated with the key to bias the key into engagement with aligned slots of the plates;

wherein the manual rotation member is operably associated with the piston to rotate the piston relative to the housing, the piston including, a first bearing surface for operable contact with a second bearing surface of the housing when the manual rotation member is rotated, wherein at least one of the first and second bearing surfaces is a ramped surface and rotation of the manual rotation member is operable to cause rotational and translational relative movement of the piston and the housing.

11. The hinge assembly of claim 10 wherein, when engaged with the aligned slots, the key extends entirely through the first locking slot.

12. The hinge assembly of claim 11 wherein the housing defines an outer cylindrical surface that provides the axis of rotation for the hinge plates.

13. The hinge assembly of claim 10 further comprising a biased plunger inside the housing and operable to yieldingly retain the key disengaged from at least one of the aligned slots.

14. A ladder hinge assembly comprising:

a first ladder hinge plate defining a first plate opening and at least one first locking slot that extends entirely through the first ladder hinge plate;

a second ladder hinge plate defining a second plate opening and at least one second locking slot;

a housing associated with the first plate and extending through the first and second plate openings, wherein the second plate is operable to rotate relative to the first plate about a rotation axis defined by the housing to selectively align first and second locking slots;

a key translatable in a direction substantially parallel to the rotation axis of the plates to selectively engage the slots when aligned to prevent relative rotation of the plates about the rotation axis when the key is engaged with the aligned slots;

a manual rotation member operably coupled to the key to selectively disengage the key from at least one of the aligned slots by rotation of the rotation member a predetermined amount from a rotation member resting position; and a biased plunger inside the housing and operable to yieldingly retain the key disengaged from at least one of the aligned slots.

* * * * *